US006769635B2

(12) United States Patent
Stewart et al.

(10) Patent No.: US 6,769,635 B2
(45) Date of Patent: Aug. 3, 2004

(54) MIXED MODE FUEL INJECTOR WITH INDIVIDUALLY MOVEABLE NEEDLE VALVE MEMBERS

(75) Inventors: Chris Stewart, Normal, IL (US); Scott A. Chockley, Washington, IL (US); Daniel R. Ibrahim, Bloomington, IL (US); Keith Lawrence, Peoria, IL (US); Jay Tomaseki, Gainsville, GA (US); Junru H. Azam, Normal, IL (US); Steven Ye Tian, Bloomington, IL (US); Scott F. Shafer, Morton, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/439,837

(22) Filed: May 16, 2003

(65) Prior Publication Data

US 2004/0055562 A1 Mar. 25, 2004

Related U.S. Application Data

(60) Provisional application No. 60/413,275, filed on Sep. 25, 2002.

(51) Int. Cl.[7] ..... B05B 1/14; F02B 1/12; F02B 1/14

(52) U.S. Cl. ..... 239/558; 239/533.2; 239/533.8; 239/585.4; 123/300; 123/459; 123/506; 123/299

(58) Field of Search ..... 123/299, 300, 123/459, 506; 239/558, 533.2, 533.8, 585.4

(56) References Cited

U.S. PATENT DOCUMENTS

| | | | | |
|---|---|---|---|---|
| 4,168,804 A | * | 9/1979 | Hofmann | 239/533.11 |
| 4,202,500 A | | 5/1980 | Keiczek | |
| 4,984,738 A | | 1/1991 | Winquist | |
| 5,458,292 A | * | 10/1995 | Hapeman | 239/533.4 |
| 5,669,334 A | | 9/1997 | Schonfeld et al. | |
| 5,875,743 A | | 3/1999 | Dickey | |
| 5,899,389 A | | 5/1999 | Pataki et al. | |
| 6,220,528 B1 | | 4/2001 | Cooke et al. | |
| 6,260,775 B1 | * | 7/2001 | Lambert et al. | 239/585.5 |
| 6,338,445 B1 | | 1/2002 | Lambert et al. | |
| 6,378,503 B1 | | 4/2002 | Lambert | |
| 6,467,702 B1 | * | 10/2002 | Lambert et al. | 239/533.8 |
| 6,516,774 B2 | * | 2/2003 | zur Loye et al. | 123/299 |
| 2003/0010845 A1 | * | 1/2003 | Carroll et al. | 239/533.2 |

FOREIGN PATENT DOCUMENTS

EP 1 069 308 A2 1/2001

* cited by examiner

*Primary Examiner*—Erick Solis
(74) *Attorney, Agent, or Firm*—Liell & McNeil

(57) ABSTRACT

A fuel injector includes a homogenous charge nozzle outlet set and a conventional nozzle outlet set controlled respectively, by first and second needle valve members. One of the needle valve members moves to an open position while the other needle valve member remains stationary for a homogeneous charge injection event. The former needle valve member stays stationary while the other needle valve member moves to an open position for a conventional injection event. One of the needle valve members is at least partially positioned in the other needle valve member. Thus, the injector can perform homogeneous charge injection events, conventional injection events, or even a mixed mode having both types of injection events in a single engine cycle.

20 Claims, 14 Drawing Sheets

55
72
61
68
67
Q
100
101
0
1
0
2
4
6
8
10
12
14
16
18
20
22

MIXED MODE FUEL INJECTOR WITH INDIVIDUALLY MOVEABLE NEEDLE VALVE MEMBERS

RELATION TO OTHER PATENT APPLICATION

This application claims the benefit of provisional application No. 60/413,275, filed Sep. 25, 2002.

GOVERNMENT RIGHTS

This invention was made with U.S. Government support under at least one of DE-FC05-97OR22605 and DE-FC05-00OR22806 awarded by the Department of Energy. The Government has certain rights in this invention.

TECHNICAL FIELD

The present invention relates generally to dual mode fuel injection systems, and more particularly to a fuel injector with individually moveable needle valve members.

BACKGROUND

Over the years, engineers have been challenged to devise a number of different strategies toward the goal of a cleaner burning engine. Experience has taught that various injection timings, quantities and rates have a variety of different desirable results over the complete operating range of a given engine. Therefore, fuel injection systems with a variety of different capabilities can generally outperform fuel injection systems with narrower capability ranges, at least in their ability to reduce undesirable emissions. For instance, the leap from mechanical control to electronic control in fuel injection systems has permitted substantially lower emissions in several categories, including but not limited to $NO_x$, hydrocarbons and smoke.

One area that appears to show promise in reducing undesirable emissions is often referred to as homogenous charge compression ignition (HCCI). In an HCCI engine, fuel is injected early in the compression cycle to permit thorough mixing with cylinder air, to ideally form a lean homogeneously mixed charge before conditions in the cylinder cause auto-ignition. Engines operating in an HCCI mode have shown relatively low outputs of undesirable emissions. Although an HCCI strategy appears promising, it has its own problems. For instance, HCCI can cause extremely high cylinder pressure rise rates and force loads, rendering it most desirable at the lower half of the engine's operating range. Many are also seeking ways to address the difficulty in controlling ignition timing in engines operating with an HCCI strategy. Thus, at this time, a pure HCCI strategy is not viable for most commercial engine applications with conventional power density requirements.

This limitation of HCCI engines has been addressed in the art by equipping an engine with an HCCI fuel injection system and a conventional fuel injection system. For instance, such a dual system is shown in U.S. Pat. No. 5,875,743 to Dickey. Although such a dual system strategy appears viable, the high expense and complexity brought by two complete injection systems renders it commercially challenged. A single fuel injector is generally not compatible with performing both HCCI and conventional injections because different spray patterns are often desirable and sometimes necessitated. Providing a structure in a single fuel injector that is capable of injecting fuel in two different spray patterns, while maintaining the ability to mass produce the fuel injector and retain consistent results, has been problematic and elusive.

The present invention is directed to one or more of the problems set forth above.

SUMMARY OF THE INVENTION

In one aspect, a fuel injector includes a first needle valve member at least partially positioned in an injector body, and a second needle valve member at least partially positioned in the first needle valve member. At least one of the injector body, the first needle valve member and the second needle valve member define a high pressure space, a first nozzle outlet set and a second nozzle outlet set, a first needle control chamber and a second needle control chamber. The first needle valve member has a closing hydraulic surface exposed to fluid pressure in the first needle control chamber, and the second needle valve member has a closing hydraulic surface exposed to fluid pressure in the second needle control chamber. Each of the needle valve members is moveable individually while the other needle valve member remains stationary.

In another aspect, a method of injecting fuel includes a step of injecting fuel through a first nozzle outlet set at least in part by relieving pressure in a first needle control chamber. Fuel is injected through a second nozzle outlet set at least in part by relieving pressure in a second needle control chamber. Each of the two injection steps are performed at least in part by moving one of a first and second needle valve member while the other of the first and second needle valve member remains stationary.

DETAILED DESCRIPTION

Figure 1:
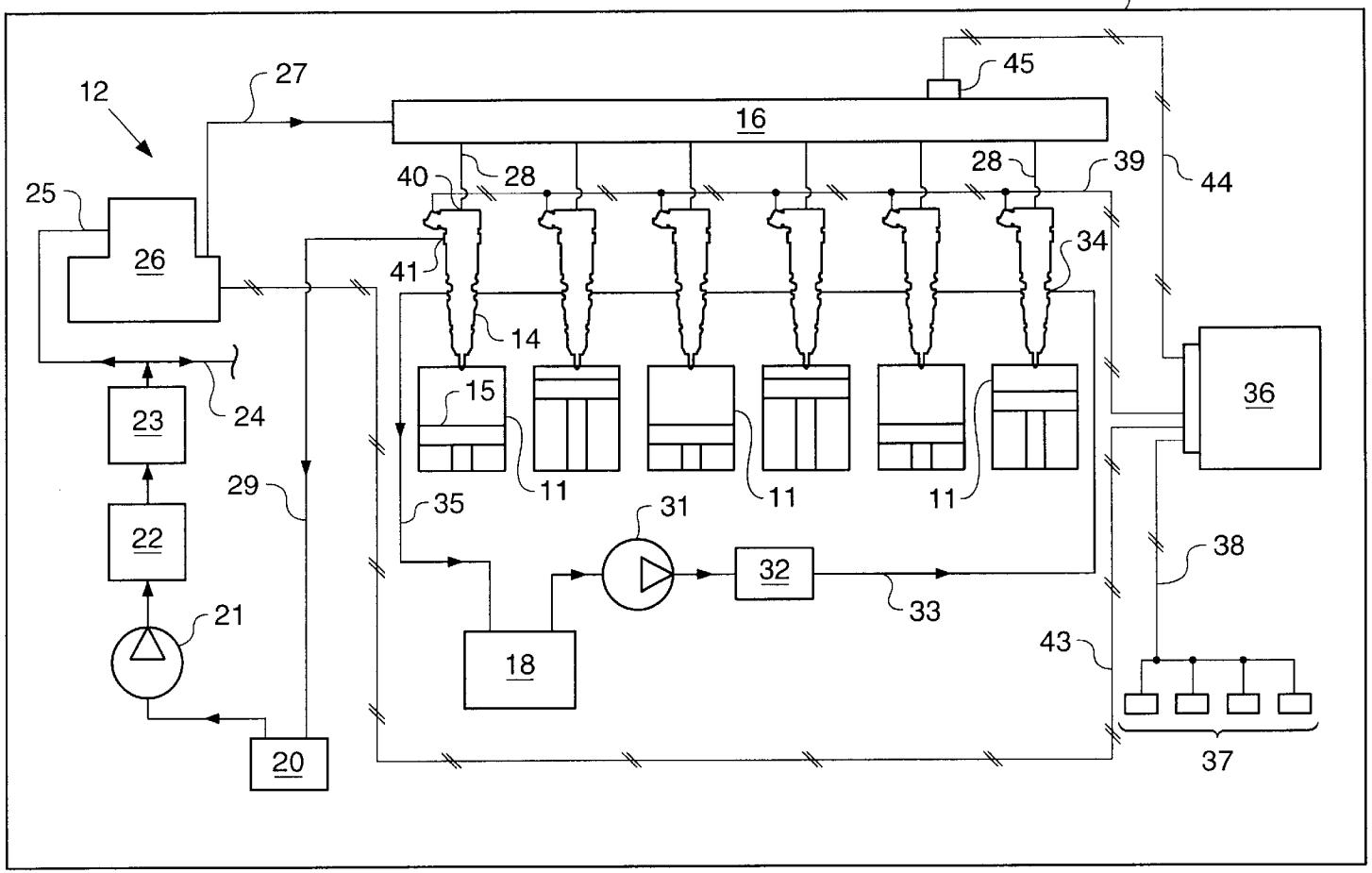
FIG. 1 is a schematic illustration of an engine and fuel injection systems according to one aspect of the present invention.

Referring to FIG. 1, an engine 10 includes a fuel injection system 12 that has a common rail 16, a plurality of fuel injectors 14 and a source of fuel 18. In the illustrated example, engine 10 includes 6 cylinders 11 that each includes a reciprocating engine piston 15. Nevertheless, those skilled in the art will appreciate that the present invention is applicable to virtually any type of internal combustion engine, but is illustrated in the context of a six cylinder diesel engine. In the illustrated example embodiment, fuel injection system 12 includes hydraulically actuated fuel injectors 14 that utilize an actuation fluid that is separate from fuel. In particular, the actuation fluid circuit draws fluid from a source of actuation fluid 20, which is preferably engine lubricating oil, but could be any other suitable and available fluid including coolant, transmission fluid and even fuel. Source of fuel 18 represents a conventional fuel tank containing distillate diesel fuel. Although the present invention is illustrated in the context of a dual-fluid pressure-intensified hydraulically-actuated fuel injection system, the present invention finds potential application in a wide variety of fuel injection systems. These include but are not limited to single fluid systems that are hydraulically actuated, mechanically actuated fuel injection systems, unit pump fuel injection systems, and common rail systems that include appropriate control features known to those skilled in the art.

Low pressure oil is pulled and circulated from the source of actuation fluid 20 by a low pressure pump 21. This relatively low pressure oil is then filtered in filter 22 and cooled in cooler 23 before branching in one direction to engine lubrication passages 24 and in another branch direction to a low pressure actuation fluid supply passage 25. Fluid supply 25 is connected to the inlet of a high pressure pump 26 that supplies high pressure actuation fluid to common rail 16 via a high pressure supply line 27. Each fuel injector 14 includes an actuation fluid inlet 40 connected to common rail 16 via a separate branch passage 28. Used actuation fluid exits fuel injectors 14 at an actuation fluid drain 41 for recirculation back to source 20 via a drain passage 29.

Pressure in common rail 16 is preferably electronically controlled by an electronic control module 36 by controlling the output of high pressure pump 26. This is preferably accomplished by matching the flow capacity of pump 26 to the flow demands of the fuel injection system 12. Control signals are communicated from electronic control module 36 to high pressure pump 26 via a communication line 43. Control of the pressure in common rail 16, is preferably accomplished via a closed loop algorithm that includes electronic control module 36 receiving common rail pressure signals via a communication line 44 from a pressure sensor 45. Thus, in the preferred system, pump output is controlled by an open loop strategy matching pump output to system demand while pressure in common rail 16 is controlled on a closed loop strategy through a comparison of desired pressure to sensed pressure. Nevertheless, those skilled in the art will appreciate that pressure in common rail 16 could be controlled in other ways known in the art.

Fuel is circulated among fuel injectors 14 by a fuel circulation pump 31 that draws fuel from source 18. After being filtered in fuel filter 32, fuel is supplied to inlets 34 of the fuel injectors 14 via a fuel supply line 33. Fuel circulation pump 31 is preferably an electric pump that has a capacity to continuously circulate an amount of fuel matched to meet the maximum projected needs of the fuel injection system 12. Unused fuel is returned to source 18 via a fuel returned passage 35 in a conventional manner. Fuel injectors 14 are preferably electronically controlled by electronic control module 36 via control signals transmitted to the individual injectors via communication lines 39 in a conventional manner. In other words, control signals to the various components are based upon known sensor signals provided to electronic control module 36 from sensors 37 via communication lines 38.

Figure 2:
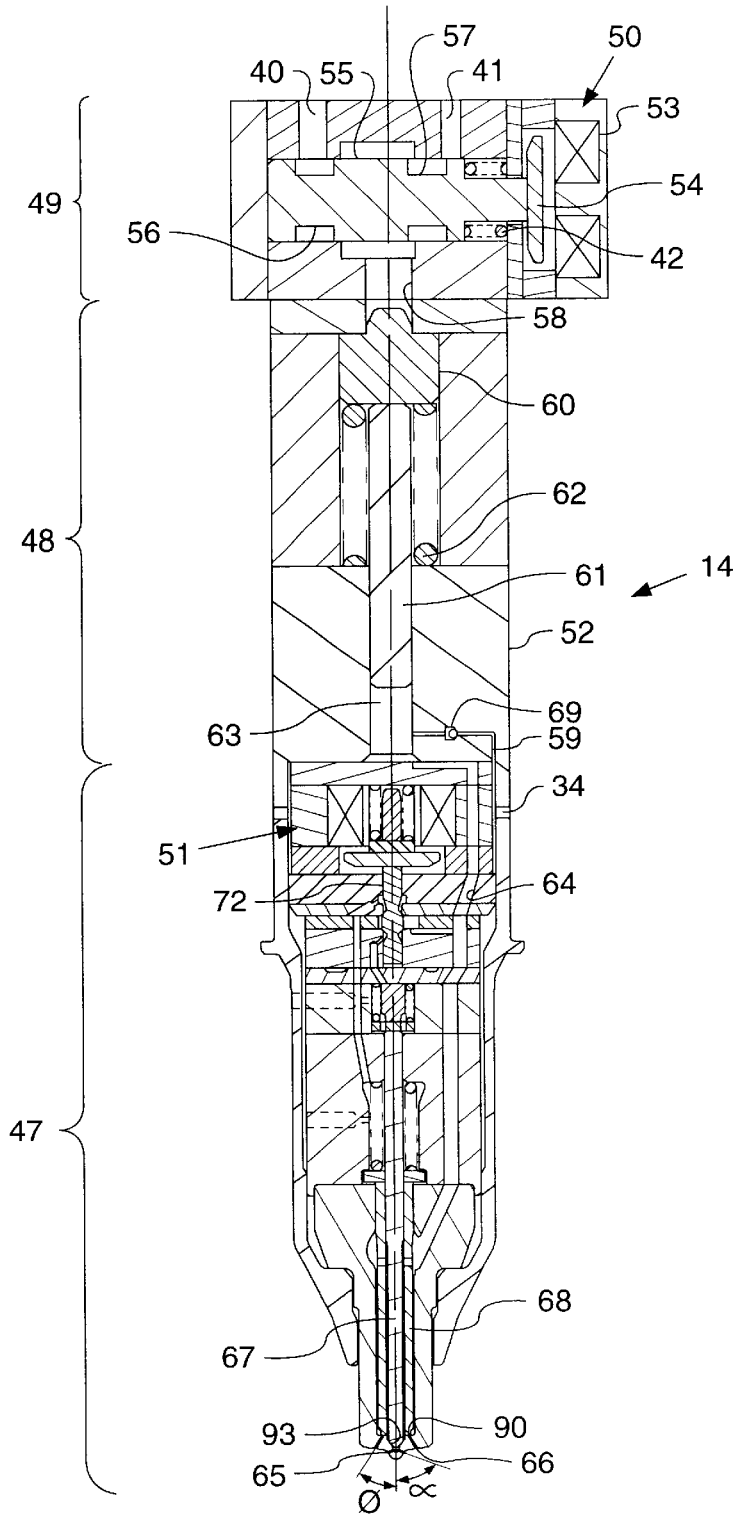
FIG. 2 is a sectioned side diagrammatic view of a fuel injector.

Referring to FIG. 2, each fuel injector 14 includes a nozzle assembly 47, a pressure intensifier 48 and a pressure control valve 49. Those skilled in the art will appreciate that although fuel injector 14 includes a nozzle assembly 47 and pressure intensifier 48 and a pressure control valve 49 all located in the same injector body 52, these separate features could be located in separate body components. In addition, some of these features could take on different forms without departing from the intended scope of the present invention. For instance, both pressure control valve 49 and pressure intensifier 48 could be replaced with a cam driven plunger, where the cam could have one or more lobes depending upon the number of injection shots desired per engine cycle. In addition, these components could be replaced with a common rail of fuel connected to nozzle assembly 47 via a suitable valve without departing from the intended scope of the present invention. In still another variant, a unit fuel pump could be connected directly to nozzle assembly 47 or a unit oil pump could be connected to pressure intensifier 48, and still fall within the intended scope of the present invention. Thus, aspects relating to electronic control and fuel pressurization of fuel can take on a wide variety of structures without departing from the present invention.

Pressure control valve 49 includes a first electrical actuator 50, which is preferably a solenoid but could be any other suitable electrical actuator such as a piezo or a voice coil. A solenoid coil 53 is operably coupled to move an armature 54 when energized. Armature 54 is attached to, or otherwise operably coupled to move with, a pressure control valve member 55. In the illustrated embodiment, pressure control valve member 55 is a spool valve member, but those skilled in the art will appreciate that other types of valve members, such as poppet valve members, could be substituted in its place. When solenoid 50 is deenergized, a biasing spring 42 biases pressure control valve member 55 toward the left to a position that connects actuation fluid cavity 58 to low pressure actuation fluid drain 41 via an annulus 57. When solenoid coil 53 is energized, armature 54 and control valve member 55 move to the right against the action of spring 42 to open the fluid connection between actuation fluid cavity 58 and high pressure actuation fluid inlet 40 via annulus 56. When this occurs, annulus 57 closes the fluid connection between actuation fluid cavity 58 and actuation fluid drain 41. Thus, depending upon the position of pressure control valve member 55 and the energization state of solenoid 50, actuation fluid cavity 58 is either connected to high pressure actuation fluid inlet 40 to pressurize fuel within the fuel injector, or connected to low pressure actuation fluid drain 41 to allow the fuel injector to reset itself between injection events. Although valve 50 has a single actuator, it could have actuators at both ends to effectuate a push-pull strategy for moving the valve member.

The pressure intensifier 48 includes a stepped top intensifier piston 60 that has a top portion exposed to fluid pressure in actuation fluid cavity 58. Although not necessary, intensifier piston 60 preferably includes a stepped top so that the high pressure actuation fluid effectively acts over only a portion of the top surface of the piston over the beginning portion of its movement. This can result in lower injection pressure over the beginning portion of a fuel injection event. Depending upon the shape and length of the stepped top, other front end rate shaping forms can also be produced, including but not limited to ramp front ends and boot shaped front end rate shaping. Intensifier piston 60 is biased upward toward its retraced position, as shown, by a return spring 62. Between injection events, when intensifier piston 60 is retracting under the action of spring 62, used actuation fluid is expelled from actuation fluid cavity 58 to actuation fluid drain 41. A plunger 61 is operably coupled to move with intensifier piston 60 to pressurize fuel in a fuel pressurization chamber 63, when undergoing its downward pumping stroke. When plunger 61 and intensifier piston 60 are retracting, fresh low pressure fuel is pushed into fuel pressurization chamber 63 via a low pressure fuel circulation passage 59 and past a check valve 69. Low pressure fuel circulation passage 59 is fluidly connected to fuel inlet 34 via the annular space created by the clearance between the injector body casing and the injector stack of components inside the same. Because intensifier piston 60 has a larger diameter than plunger 61, fuel pressure in fuel pressurization chamber 63 can be raised to several times that of the actuation fluid pressure contained in common rail 16 (FIG. 1).

Figure 3:
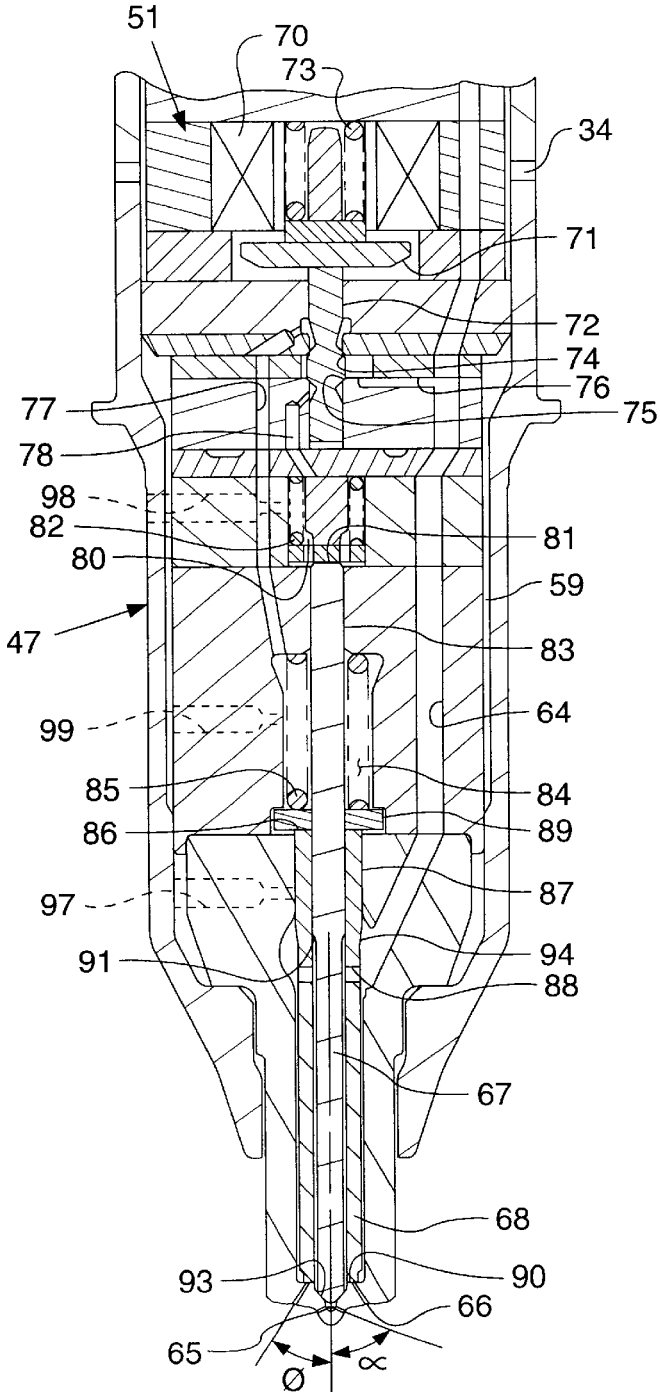
FIG. 3 is a sectioned side diagrammatic view of the nozzle assembly portion of the fuel injector of FIG. 2.

Referring in addition to FIG. 3, nozzle assembly 47 includes a nozzle supply passage 64 extending between fuel pressurization chamber 63 and a homogenous charge nozzle outlet set 66 and a conventional nozzle outlet set 65. The opening and closing of nozzle outlet sets 65 and 66 are controlled by a first needle valve member 67 and a second needle valve member 68, respectively. When plunger 61 is undergoing its downward pumping stroke, nozzle supply passage 64 can be considered to be a high pressure passage containing fuel at injection pressure levels. Which of the homogenous charge nozzle outlet set 66 or the conventional nozzle outlet set 65 will open during an injection event depends upon the positioning of a needle control valve member 72, which is operably coupled to a second electrical actuator 51. Homogenous charge nozzle outlet set 66 includes one or more nozzle outlets that are oriented at a relatively low angle ($\theta$) with respect to the centerline of the fuel injector. Those skilled in the art will appreciate that homogenous charge nozzle outlets are oriented in a way to produce mixing of fuel and air while the engine piston is undergoing its compression stroke. Conventional nozzle outlet set 65 includes one or more nozzle outlets oriented at a relatively high angle ($\alpha$) with respect to the injector body centerline in a conventional manner. The average angle ($\theta$) is generally substantially smaller than the average angle ($\alpha$), which are most often greater than 60°.

The first needle valve member 68 includes a closing hydraulic surface 86 exposed to fluid pressure in a first needle control chamber 84, and an opening hydraulic surface 94 exposed to fluid pressure in nozzle supply passage 64. First needle valve member 68 is biased toward a downward position in contact with first valve seat 90 to close homogenous charge nozzle outlet set 66 by a first biasing spring 85, which is located in first needle control chamber 84. Valve seat 90 is preferably an annular flat seat that is arranged with respect to homogenous charge nozzle outlet set 66 in such a way that valve member 68 covers those outlets when in its downward closed position as shown. Thus, in this embodiment, homogenous charge nozzle outlet set 66 preferably surrounds conventional nozzle outlet set 65. This strategy allows for a relatively small sac in relation to the conventional nozzle outlet set 65 using known and time tested tip techniques developed over the past decades. In addition, this arrangement allows for multiple small diameter holes arranged in a shower head pattern of the type shown in FIG. 6 in relation to the homogenous charge nozzle outlet set. Engineers have observed that when the homogenous nozzle outlet set has more small diameter outlets arranged in an non-impinging manner, better mixing and lower emissions can be achieved. In this embodiment the conventional nozzle outlet set 65 includes six relatively large diameter nozzle outlets distributed and oriented in the conventional manner to produce a conventional spray pattern (see FIG. 5) known in the art.

The second needle valve member 67 includes a second closing hydraulic surface 81 exposed to fluid pressure in a second needle control chamber 80, and an opening hydraulic surface 91 exposed to fluid pressure in nozzle supply passage 64 via fluid connection passage 88. Second needle valve member 67 is normally biased downward into contact with second annular needle seat 93 to close conventional nozzle outlet set 65 via the action of second biasing spring 82. The strengths of springs 82 and 85 as well as the sizing of opening hydraulic surfaces 91 and 94 are preferably such that both the first and second needle valve members have similar valve opening pressures. Nevertheless, those skilled in the art will appreciate that these aspects could be varied to produce different valve opening pressures for the two different needle valve members to produce some desired effect. As used in this patent, a valve member of any type can be one or more components that are attached, or otherwise coupled, to move together as a single unit. The maximum upward travel distance of needle valve member 67 is determined by the spacer thickness portion and stop piece portions of first needle valve member, which are located in first needle control chamber 80. The maximum upward travel distance of needle valve member 68 is determined by the spacer 89, which is preferably a thickness category part. Second needle control chamber 80 is substantially fluidly isolated from first needle control chamber 84 by a guide portion 83. Likewise, first needle control chamber 84 is substantially fluidly isolated from nozzle supply passage 64 via a guide region 87.

The positioning of needle control valve member 72 determines which of the needle control chambers 80 or 84 is connected to the high pressure in nozzle supply passage 64 and hence which of the needle valve members 67 or 68 will lift to an open position during an injection event. Second electrical actuator 51 is preferably operably coupled to needle control valve member 72 via connection to an armature 71. Second electrical actuator 51 is shown as a solenoid but could be any other suitable electrical actuator including but not limited to a piezo or a voice coil. Needle control valve member 72 is normally biased downward into contact with second valve seat 75 via a biasing spring 73. When in this position, first needle control chamber 84 is fluidly connected to nozzle supply passage 64 via a pressure communication passage 77, past a first valve seat 74 and via a connection passage 76. When in this position, second needle control chamber 80 is fluidly isolated from nozzle supply passage 64 due to the closure of second valve seat 75. In the preferred embodiment, second needle control chamber 80 is a closed volume except for second pressure communication passage 78. However, in some instances, it may be desirable to connect second needle control chamber 80 to annular low pressure fuel circulation passage 59 via a restricted vent passage 98 (shown in shadow of FIG. 3). The inclusion of an unobstructed but restrictive vent passage 98 might be desirable in those cases where leakage of high pressure fuel into second needle control chamber 80 during an injection event is sufficient to cause second needle valve member 67 to be closed prematurely. When vent passage 98 is not included, second needle valve member 67 can lift to its upward open position into the relatively closed volume of first needle control chamber 80, since the same will be at low pressure if an injection event is initiated when second electrical actuator 51 is deenergized. Preferably, vent passage 98 is omitted and the reduction in volume of the needle control chamber 80 caused by lifting of needle valve member 67 is accommodated by the compressibility of the fuel.

If second electrical actuator 51 is energized, solenoid coil 70 attracts armature 71 and lifts needle control valve member 72 upward to close first valve seat 74 and open second valve seat 75. When this occurs, second needle control chamber 80 becomes fluidly connected to high pressure in nozzle supply passage 64 to prevent second needle valve member 67 from lifting off of first needle seat 93 due to the high pressure hydraulic force acting on closing hydraulic surface 81. Provided second electrical actuator 51 is energized before fuel pressure and nozzle supply passage 64 has increased for an injection event, low pressure will exist in first needle control chamber 84 due to the closure of valve seat 74. Preferably, first needle control chamber 84 is a closed volume except for pressure communication passage 77, but could be connected to low pressure fuel circulation passage 59 via an unobstructed but restricted vent passage 99 in the event that fuel leakage between the various components is a concern. When first needle control chamber 84 is at low pressure and fuel pressure in nozzle supply passage 64 increases to injection levels and acts upon opening hydraulic surface 94, first needle valve member 68 will lift upward to open homogenous charge nozzle outlet set 66 to nozzle supply passage 64. Vent passage 99 is preferably omitted, but can be included if leakage and/or fluid displacement caused by moving the needle valve member 68 to an open position produce a need for a vent. In addition or alternatively, a vent passage 97, which connects to an annulus in outer valve member 68, can be used to control leakage flow.

Figure 4:
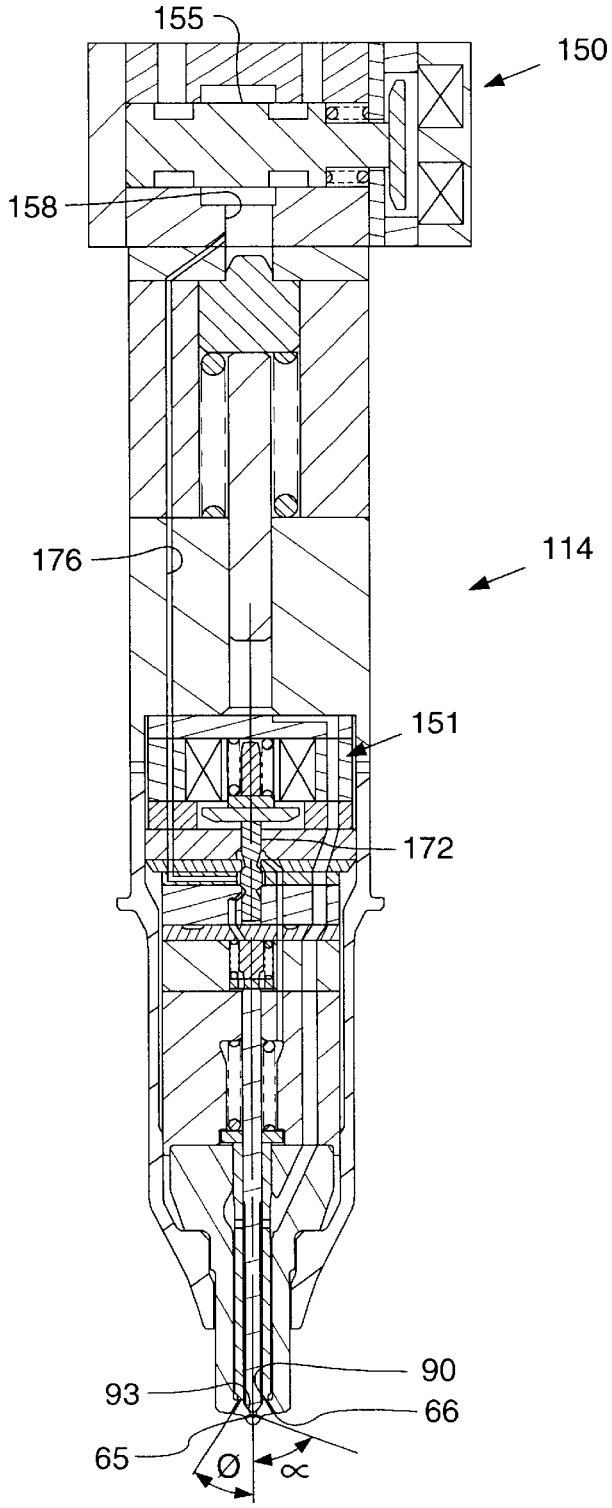
FIG. 4 is a sectioned side diagrammatic view of another fuel injector for the system of FIG. 1.

Referring now to FIG. 4, a hydraulically actuated fuel injector 114 is very similar to that shown in FIG. 2 except that it includes a connection passage 176 connected to the actuation fluid cavity 158 rather than a connection passage 76 fluidly connected to the nozzle supply passage 64 as shown in the embodiment of FIG. 2. Thus, in the embodiment of FIG. 4, actuation fluid is channeled to the needle control chambers based upon the positioning of needle control valve member 172, based upon the energization state of electrical actuator 151. Like the embodiment of FIG. 2, the pressure control valve member 155, which controls the pressure in actuation fluid cavity 158 is controlled in its position by a first electrical actuator 150. Thus, the embodiment of FIG. 4 is virtually identical to that of the embodiment of FIG. 2 except that high pressure or low pressure oil is applied to the closing hydraulic surfaces of the needle valve members rather than fuel pressure as in the embodiment of FIG. 2.

Figure 5:
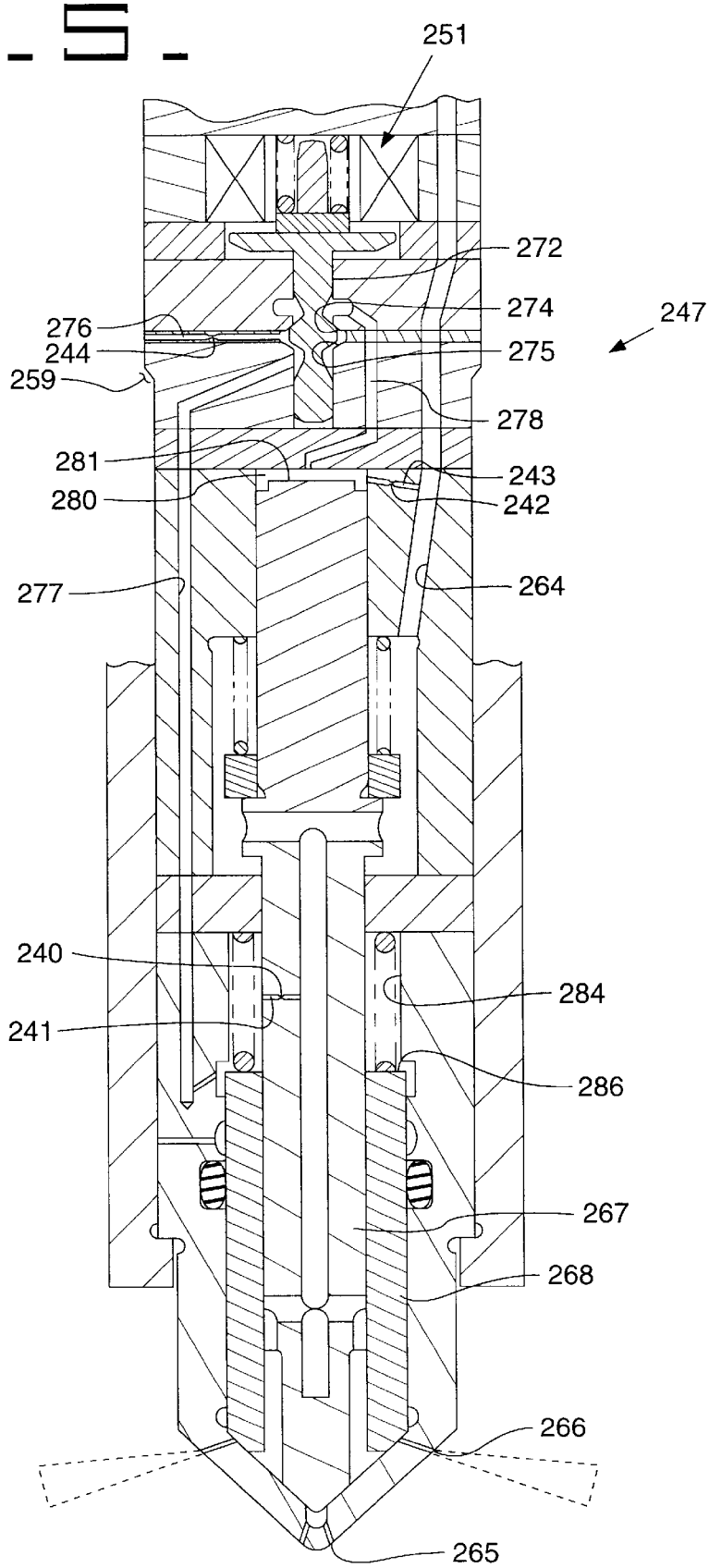
FIG. 5 is a sectioned side diagrammatic view of a fuel injector nozzle assembly according to still another mixed mode fuel injector.

Referring now to FIG. 5, a nozzle assembly 247 could be substituted in place of the nozzle assembly 47 shown in the embodiment of FIG. 2, or could be a stand alone fuel injector within a different type of fuel injection system that includes a means other than that shown in FIGS. 1 and 2 for pressurizing fuel and controlling the flow of same to the fuel injector. This embodiment differs from the nozzle assembly 47 shown in FIG. 3 in that its connection passage 276 is fluidly connected to the low pressure fuel circulation area 259 rather than a connection passage 76 fluidly connected to the nozzle supply passage 64 as in the FIGS. 2–3 embodiment. Thus, in this embodiment the needle control valve member 272 moves between first valve seat 274 and second valve seat 275 to connect either first needle control chamber 280 or second needle control chamber 284 to low pressure fuel passage 259. In this embodiment, first needle control chamber 280 is fluidly connected to nozzle supply passage 264 via an unobstructed connection passage 243 that includes a flow restriction 242, which is more restrictive than a flow restriction 244 located in vent connection passage 276. Because of these flow restrictions and the various passageways, first needle control chamber 280 will drop to a relatively low pressure when needle control valve member 272 is in its downward position opening first valve seat 274. In other words, pressure in first needle control chamber 280 will be somewhere between that in nozzle supply passage 264 and low pressure fuel circulation passage 259. Because flow restriction 242 is more restrictive than flow restriction 244 when in this position, first needle control chamber 280 will be at a relatively low pressure since it is fluidly connected to low pressure fuel circulation passage 259 via pressure communication passage 278 and vent connection passage 276. This embodiment also differs from the previous embodiments in that needle valve members 267 and 268 have hydraulic stops rather than physical stops as in the previous embodiments.

When electrical actuator 251 is energized to lift needle control valve member 272 upward to open second valve seat 275, second needle control chamber 284 becomes fluidly connected to low pressure fuel circulation passage 259 via pressure communication passage 277 and vent connection passage 276. When this occurs the pressure in needle control chamber 284 will be somewhere between that in nozzle supply passage 264 and fuel circulation passage 259, since second needle control chamber 284 is fluidly connected via an unobstructed connection passage 241 to nozzle supply passage 264. However, because flow restriction 240 is more restrictive than flow restriction 244, pressure in second needle control chamber 284 will drop when needle control valve member 272 is in its upward position opening seat 275. Like the earlier embodiments, a first needle control valve member 267 controls the opening and closing of a homogenous charge nozzle outlet set 265. First needle valve member 267 includes a closing hydraulic surface 281 exposed to fluid pressure in first needle control chamber 280. When first needle valve member 267 is in its upward open position, closing hydraulic surface 281 finds an equilibrium position in which pressure communication passage 278. The second needle valve member 268 controls the opening and closure of conventional nozzle outlet set 266. Second needle valve member 268 includes a closing hydraulic surface 286 exposed to fluid pressure in second needle control chamber 284. In a similar manner, the second needle valve member 268 will nearly close pressure communication passage 277 to needle control chamber 284 when in its upward open position. FIG. 5 is also relevant for showing an example conventional spray pattern, which is well known in the art.

Figure 6:
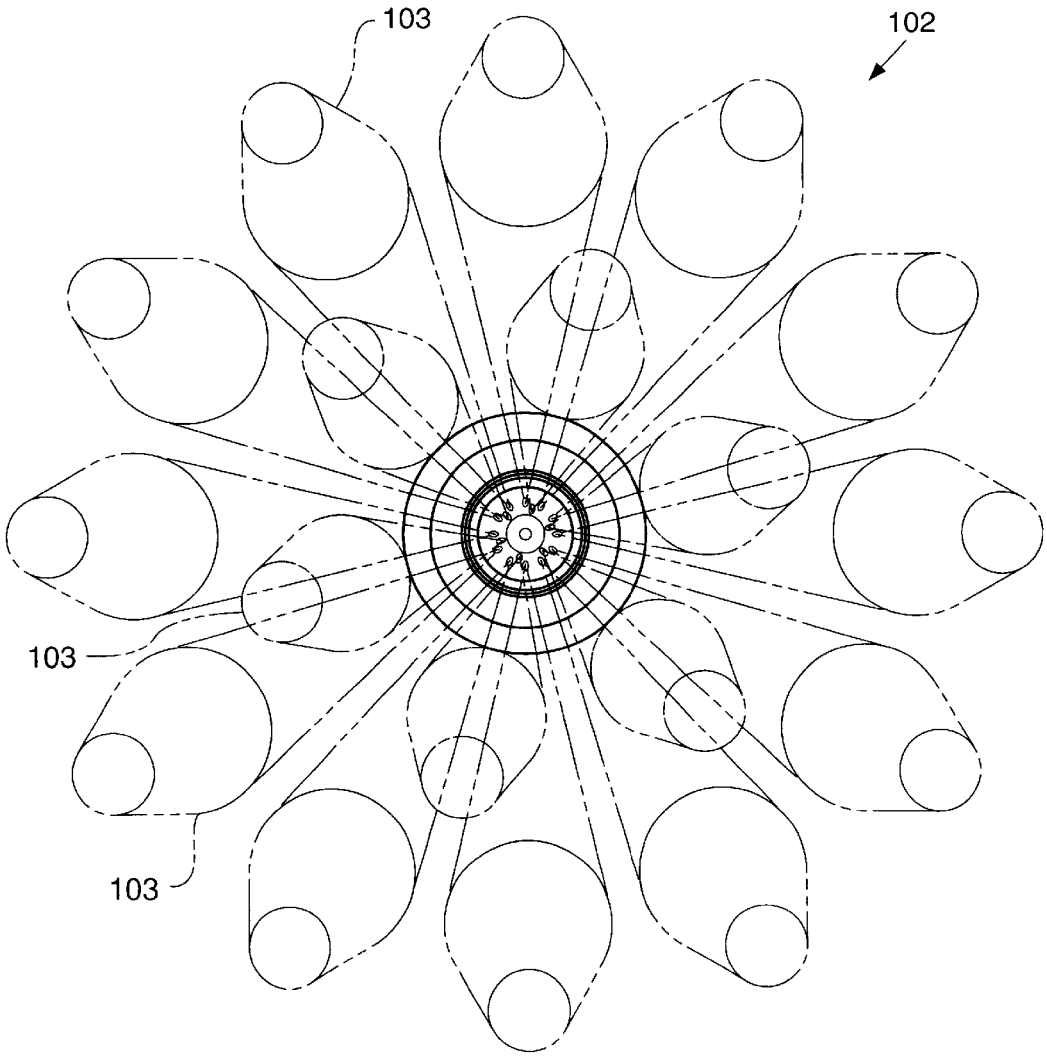
FIG. 6 is a bottom view of a homogenous charge spray pattern according to one aspect of the present invention.

Referring now to FIG. 6, a homogenous charge shower head spray pattern is illustrated as would be preferred in any of the previous embodiments. Preferably, the homogenous charge nozzle outlet set produces a spray pattern having relatively large number of plumes that do not intersect or overlap with one another. Engineers have observed that a multi-hole spray pattern having this arrangement can promote better fuel and air mixing, which can result in even lower undesirable emissions. In the illustrated example, homogenous charge spray pattern 102 includes 18 separate nozzle outlets that each produce a plume 103 as generally shown in FIG. 6. Those skilled in the art will appreciate that, although a shower head pattern may be preferred, the homogenous charge nozzle outlet set can be sized and arranged to produce any suitable spray pattern that promotes adequate fuel air mixing. In addition, in other embodiments, it may be desirable to have plumes of adjacent nozzle outlets in the homogenous charge nozzle outlet set overlap, impinge or possibly even intersect one another to produce some desired affect, such as better fuel and air mixing.

Figure 7:
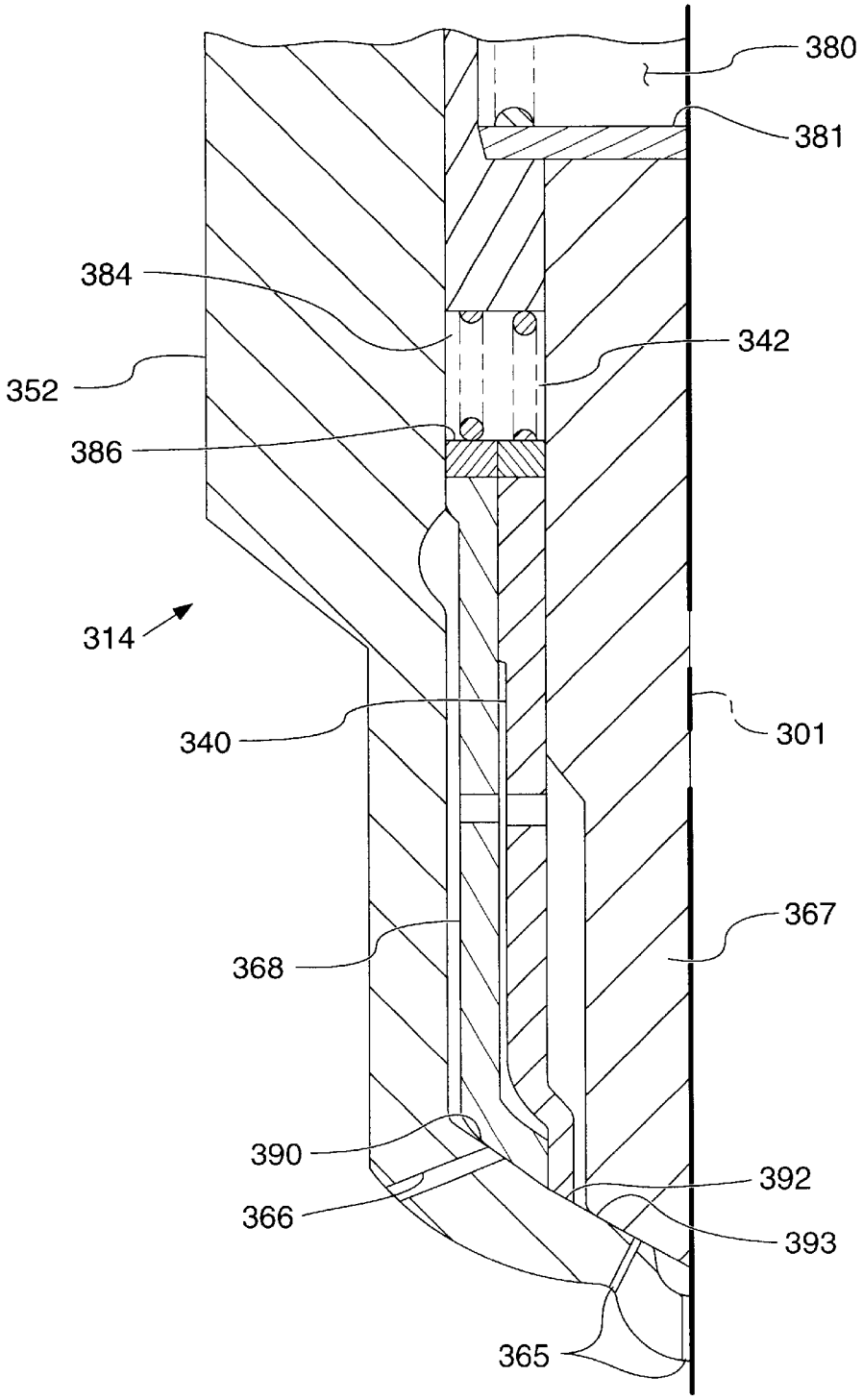
FIG. 7 is an enlarged sectioned side view of the tip portion of a fuel injector according to another embodiment of the present invention.

Referring now to FIG. 7, a fuel injector 314 according to still another embodiment of the present invention includes a separate valve member 340 that allows first and second needle valve member 367 and 368 to separately move to there upward open positions so that fuel spray is limited to one or the other of homogenous charge nozzle outlet set 365 or conventional nozzle outlet set 366. Fuel injector 314 could be substituted into any of the previous embodiments. Fuel injector 314 includes an injector body 352 that defines a centerline 301. A conventional needle valve member 368 is positioned in injector body 352 and is moveable between a downward position closing seat 390, as shown, and an upward position in which conventional nozzle outlet set 366 is open. Needle valve member 368 is normally biased to its downward closed position by a biasing spring located in needle control chamber 384. In addition, needle valve member 368 includes a closing hydraulic surface 386 exposed to fluid pressure in needle control chamber 384. A second needle valve member 367 is positioned at least partially inside of first needle valve member 368 and is biased toward a downward closed position, as shown, in contact with valve seat 393 to close homogenous charge nozzle outlet set 365. Like the previous embodiments, needle valve member 367 includes a closing hydraulic surface 381 exposed to fluid pressure in needle control chamber 380. Although not shown, needle control chambers 380 and 384 can be fluidly connected to a needle control valve in any of the manners described with regard to the previous embodiments.

In order to prevent simultaneous spray through outlet sets 365 and 366, an auxiliary valve member 340 is biased to a position in contact with valve seat 392 by a biasing spring 342 located in needle control chamber 384. Valve member 340 preferably stays in its downward closed position at all times. In this way, fuel sprays only out of homogenous charge nozzle outlet set 365 when needle valve member 367 is in its upward open position but outer needle valve member 368 is in its downward closed position. Likewise, fuel only sprays out of conventional nozzle outlet set 366 when outer needle valve member 368 is in its upward open position but inner needle valve member 367 is in its downward closed position.

Figure 8:
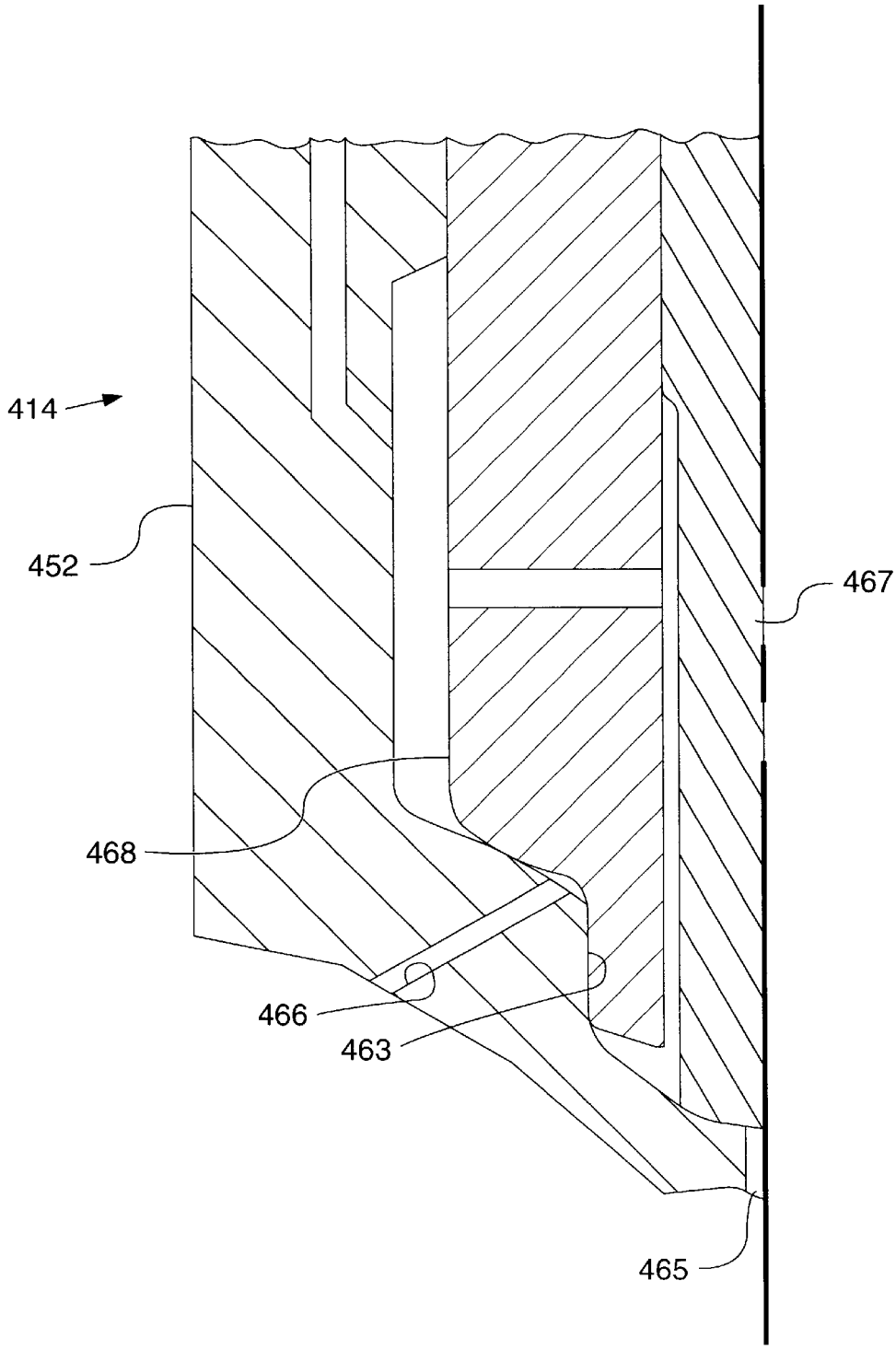
FIG. 8 is an enlarged sectioned side view of a tip portion of a fuel injector according to still anther embodiment.

Referring now to FIG. 8, the tip portion of a fuel injector 414 according to still another embodiment of the present invention includes an injector body within which an inner needle valve member 467 and an outer needle valve member 468 are positioned. This embodiment differs from the previous embodiments in that a guide/seal area 463 serves as the means by which respective nozzle outlet sets 465 and 466 are isolated from one another. However, this embodiment is similar to the previous embodiments in that inner needle valve member 467 can move to its upward open position while outer needle valve member 468 stays in its downward closed position, and vice versa. Thus, the tip portion of fuel injector 414 could be substituted into any of the previous embodiments without departing from the present invention. Guide/seal area 463 is preferably a relatively fluid tight clearance that allows outer needle valve member 468 to move, but the diametrical clearance and the length of the guide area are such that very little fluid leaks past guide/seal area 463 when one or the other needle valve members 467 and 468 are in their upward open position during an injection event.

Figure 9A:
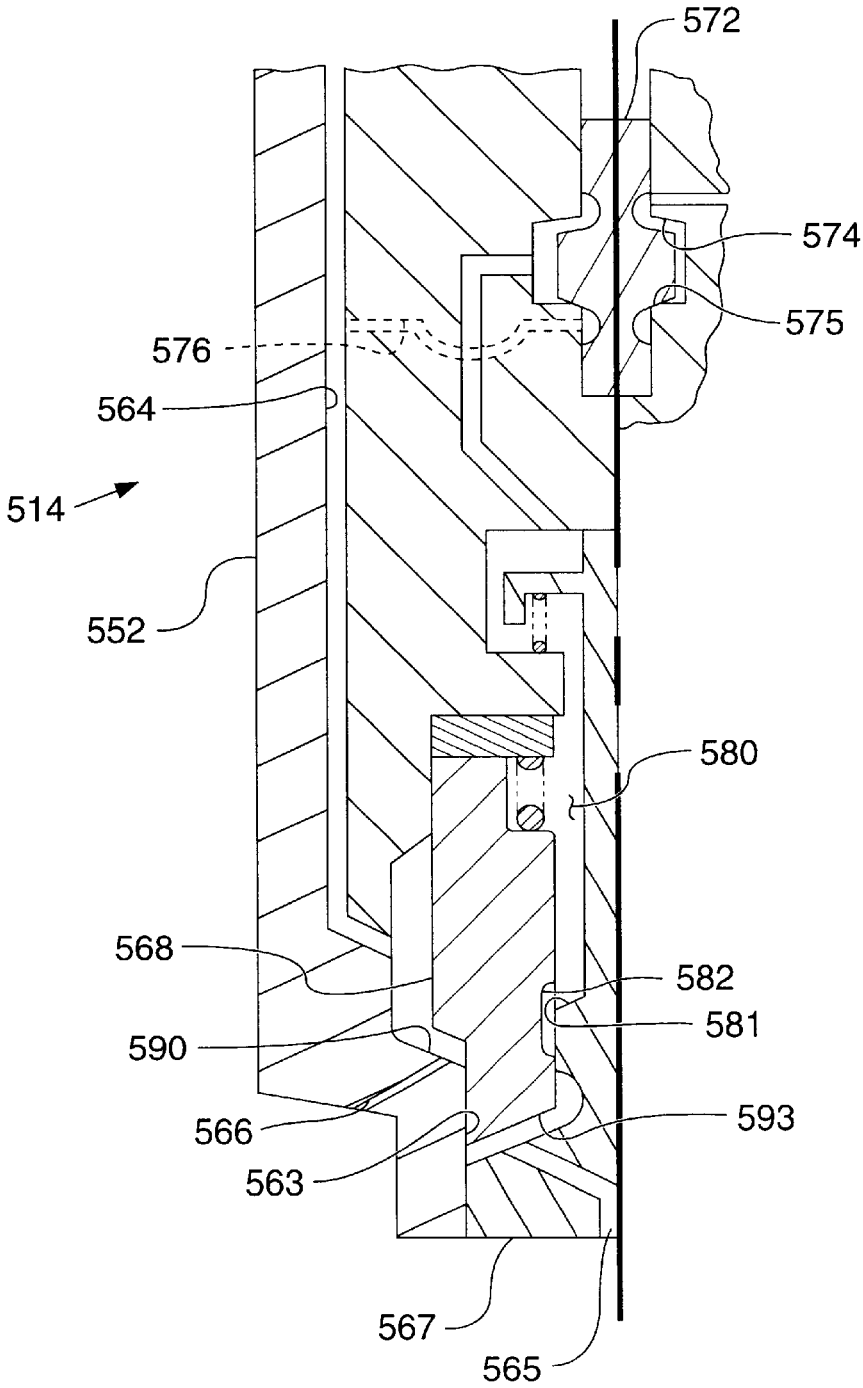
FIGS. 9*a* and 9*b* are sectioned schematic illustrations of a fuel injector according to still another embodiment when in its conventional operation mode and homogenous charge operation mode, respectively.
Figure 9B:
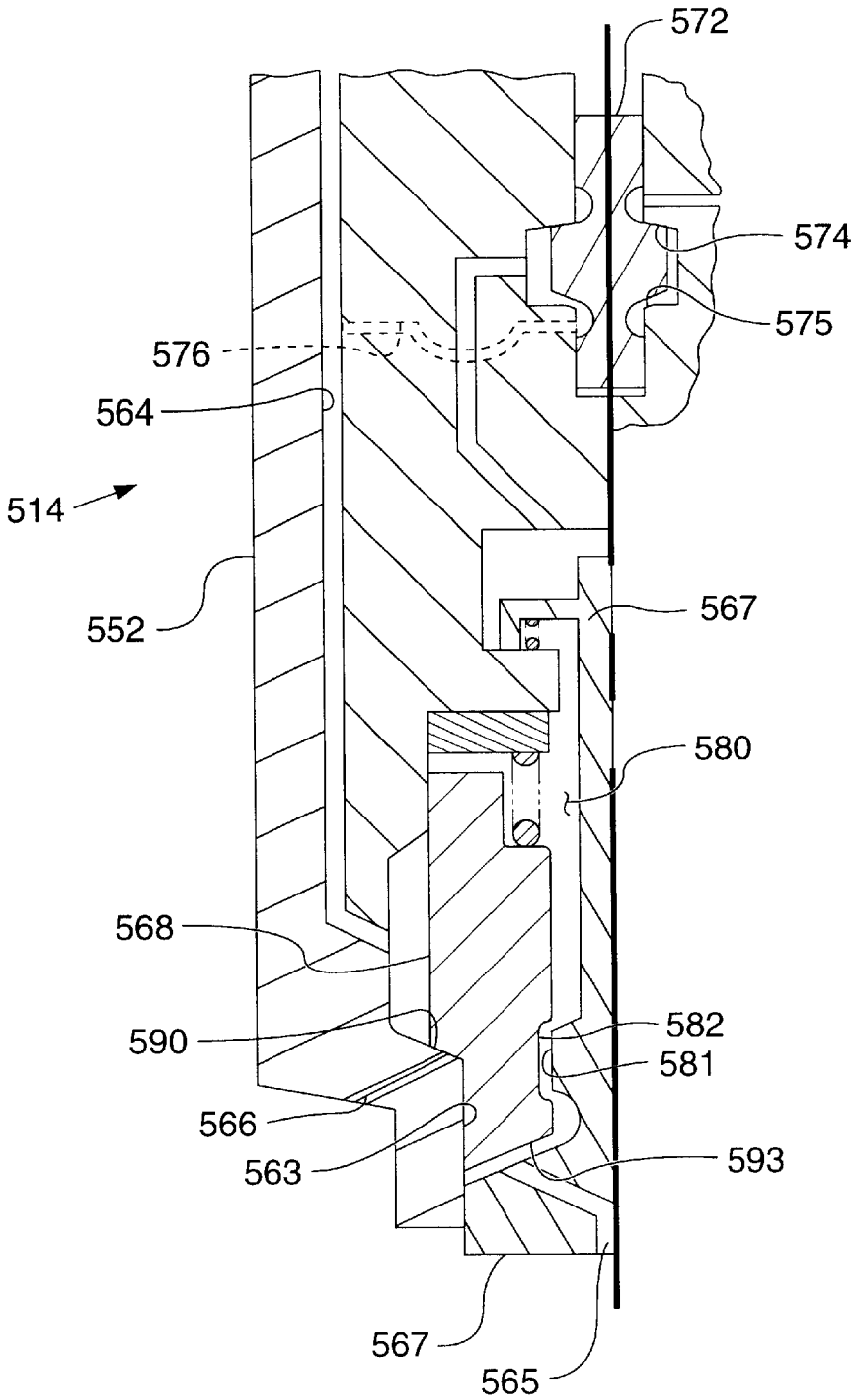

Referring now to FIGS. 9*a* and 9*b*, a fuel injector 514 according to still another embodiment of the present invention is similar to the previous embodiments in that the needle valve members 567 and 568 can move separately while the other remains in its stationary closed position. However, this embodiment differs in several respects including the fact that inner needle valve member 567 is an outwardly opening needle valve member as opposed to an inwardly opening needle valve member as in all of the previous embodiments. In addition, this embodiment differs in that flow to homogenous charge nozzle outlet set 565 flows past needle control valve member 572, rather than simply being a branch of the nozzle supply passage 564 as in the previous embodiments. FIG. 9*a* shows fuel injector 514 when conventional needle valve member 568 is in its upward open position out of contact with seat 590 to open conventional nozzle outlet set 566. Inner needle valve member 567 remains stationary. No spray comes out of homogenous charge nozzle outlet set 565 when the injector 514 is in the configuration shown in FIG. 9*a* since needle control chamber 580 is fluidly connected to a low pressure drain past valve seat 574 and blocked to the outlet set by an annular projection 581 blocking fluid flow around annulus 582. Thus, outer needle valve member 568 will move to its upward open position when needle valve member 572 is in its downward position closing seat 575 and fuel pressure in nozzle supply chamber 564 is above a valve opening pressure.

When it is desired to inject fuel out of homogenous charge nozzle outlet set 565, needle control valve member 572 is moved upward to open high pressure seat 575 and close low pressure seat 574. This allows high pressure flow in nozzle supply passage 564 to flow past needle control valve 572 and into needle control chamber 580 through annulus 582 past annular projection 581, past valve seat 593 to nozzle outlet set 565. Thus, a homogenous charge injection event occurs by moving inner needle valve member 567 downward out of contact with valve seat 593. When this occurs, outer needle valve member 568 is maintained in its downward closed position in contact with valve seat 590 via the combined force of a biasing spring and a hydraulic force acting on an annular shoulder in needle control chamber 580. As in the previous embodiment, fuel spray is limited to one or the other of nozzle outlet sets 565 and 566 due to the inclusion of a guide/seal area in between injector body 552 and outer needle valve member 568. In other words, the diametrical clearance between outer needle valve member 568 and injector body 552 at guide/seal area 563 is sufficiently tight and of a length that allows outer needle valve member 568 to move but substantially prevents fuel leakage past this area toward the nozzle outlet set that is intended to remain closed.

Figure 11:
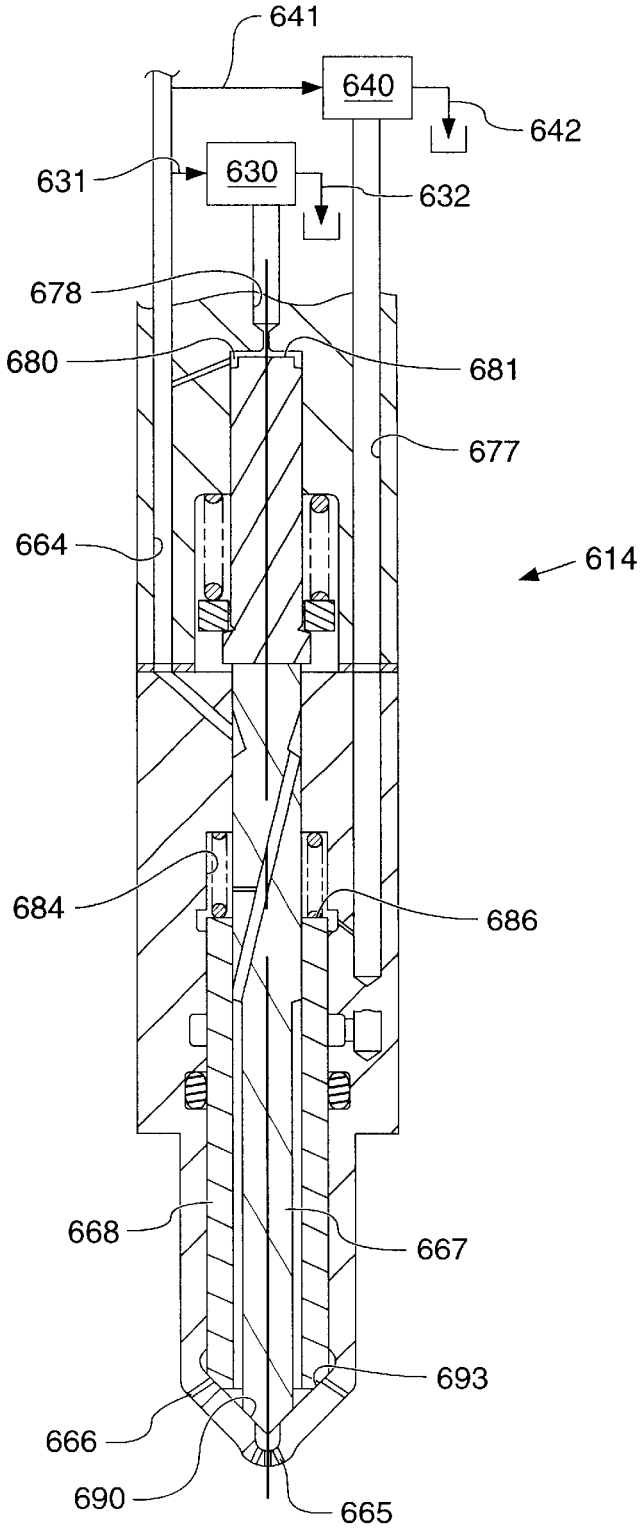
FIG. 11 is a sectioned diagrammatic view of a fuel injector according to still another embodiment of the present invention.

Referring now to FIG. 11, a fuel injector 614 according to still another embodiment includes separate three way valves 630 and 640 for each of the two needle valve members 667 and 668. This embodiment is also similar to the embodiment of FIG. 3 in that the needle valve members 667 and 668 have hydraulic stops rather than physical stops as in the other embodiments. This embodiment is similar to the other embodiments in that each of the needle valve members 667 and 668 can move separately to its open position while the other needle valve member remains stationary in a closed position. In addition, this embodiment allows for independent direct control of the two separate needle valve members 667 and 668 via the separate three way needle control valve 630 and 640. Preferably, needle control valve 630 is biased to a position in which branch passage 631 is fluidly connected to pressure communication passage 678. Thus, in this way, inner needle valve member 667 will remain in its downward closed position when fuel pressure and nozzle supply passage 664 is at injection pressure levels. A homogenous charge injection event can then be initiated by energizing an electrical actuator coupled to control valve 630 to connect the pressure communication passage 678 to low pressure vent passage 632 which relieves fluid pressure in needle control chamber 680 and hence on closing hydraulic surface 681. This allows inner needle valve member 667 to move upward off of valve seat 690 to open homogenous charge nozzle outlet set 665.

A conventional injection event is accomplished in much a similar manner except utilizing control valve 640. In other words, control valve 640 is preferably biased to a position in which branch passage 641 is open to pressure communication passage 677 to apply high pressure onto closing hydraulic surface 686, which is located at needle control chamber 684. When an electrical actuator coupled to control valve 640 is energized, control valve 640 will connect pressure communication passage 677 to drain vent passage 642 to relieve pressure in needle control chamber 684 and hence on closing hydraulic surface 686. This will allow outer needle valve member 668 to lift to its upward open position off of valve seat 693 to open conventional nozzle outlet set 666. The conventional injection event is ended by moving control valve 640 back to its original position in which branch passage 641 is connected to pressure communication passage 677.

Those skilled in the art will appreciate that all of the illustrated embodiments show a first needle valve member at least partially positioned within the second needle valve member in a concentric relationship. In all of the embodiments, the conventional nozzle outlet set and the homogenous charge nozzle outlet set are controlled in their opening and closing by separate needle valve members, one of which is at least partially positioned inside of the other. In addition, each of the needle valve members can move to an open position while the other needle valve member remains stationary in its closed position. Finally, all of the embodiments include some features that prevents fuel leakage toward the nozzle outlet set that is closed while the other nozzle outlet set is open. In a preferred embodiment, only one of the two nozzle outlet sets is open at a time. However, the embodiment of FIG. 11 allows for the possibility of both nozzle outlet sets being open simultaneously, and the features that allow that injector to do so could be incorporated into any of the other embodiments without departing from the intended scope of the present invention. Another feature shared in common with all of the embodiments is that each of the two needle valve members includes a closing hydraulic surface exposed to fluid pressure in a needle control chamber. In all of the embodiments except for that shown in FIGS. 9*a* and 9*b*, the closing hydraulic surfaces of the two needle valve members are exposed to separate needle control chambers that are substantially fluidly isolated from one another.

Figure 12:
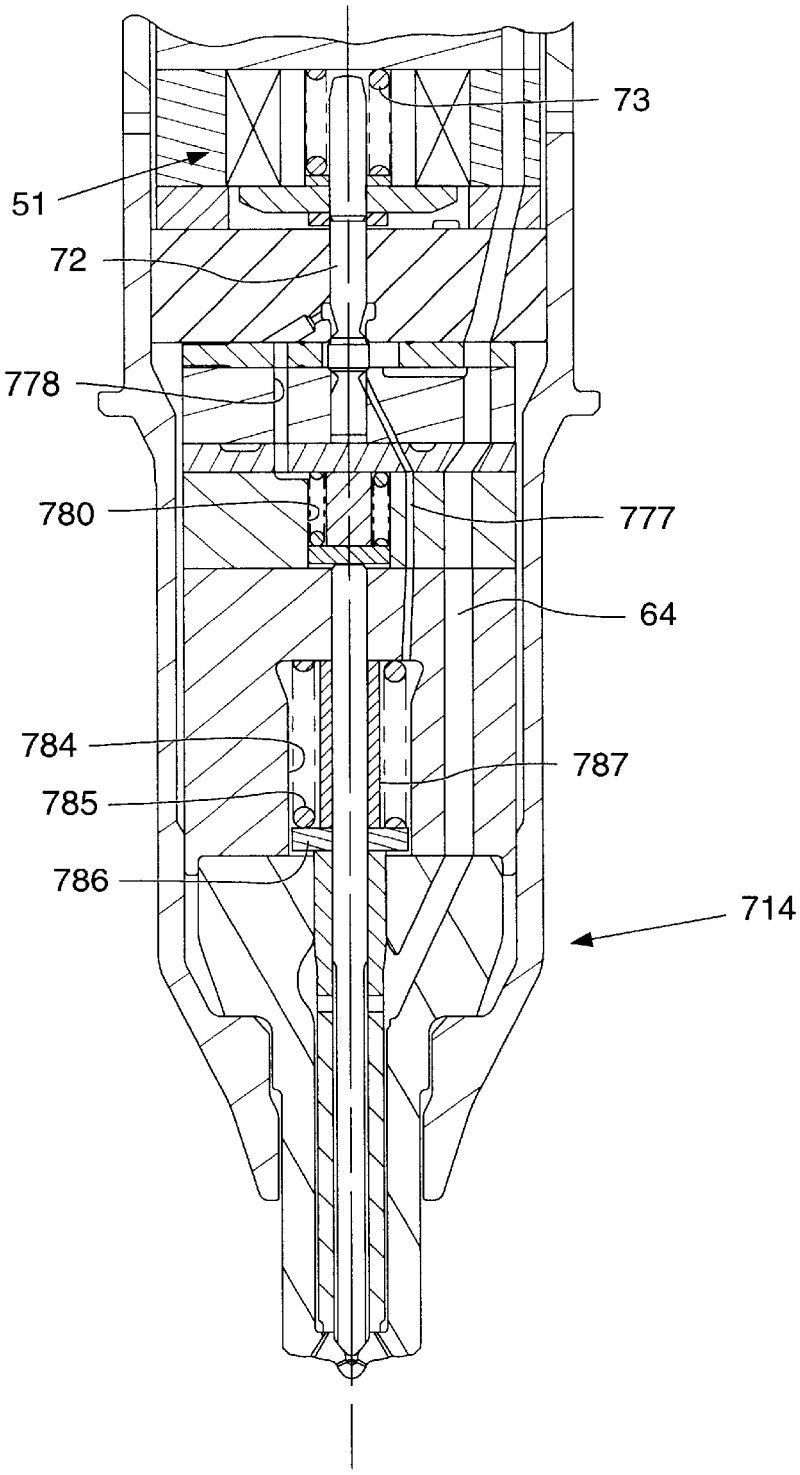
FIG. 12 is a sectioned side diagrammatic view of a nozzle assembly portion of a fuel injector according to another aspect of the present invention.

Referring now to FIG. 12, a fuel injector 714 is very similar to the fuel injector 14 shown in FIGS. 2 and 3 except that the plumbing has been altered so that the needle control chamber associated with the conventional nozzle outlets is normally in communication with nozzle supply passage 64, whereas the embodiment of FIGS. 2 and 3 show the needle control chamber 84 associated with the homogenous charge nozzle outlet set 66 is normally fluidly connected to nozzle supply passage 64. In particular, in FIG. 12, needle control valve member 72 is normally biased downward to fluidly connect needle control chamber 780 to nozzle supply passage 64 via pressure communication passage 778. When second electrical actuator 51 is energized, needle control valve member 72 is lifted to a position that fluidly connects nozzle supply passage 64 to the other needle control chamber 784 via pressure communication passage 777. The fuel injector 714 also differs from the fuel injectors of FIGS. 2 and 3 via the inclusion of a lift spacer 787 that is used to set the lift distance of the outer needle valve member. In addition, a VOP spacer 786 can be chosen to set the pre-load on biasing spring 785 and hence the valve opening pressure of the outer needle valve member in a conventional manner.

Figure 13:
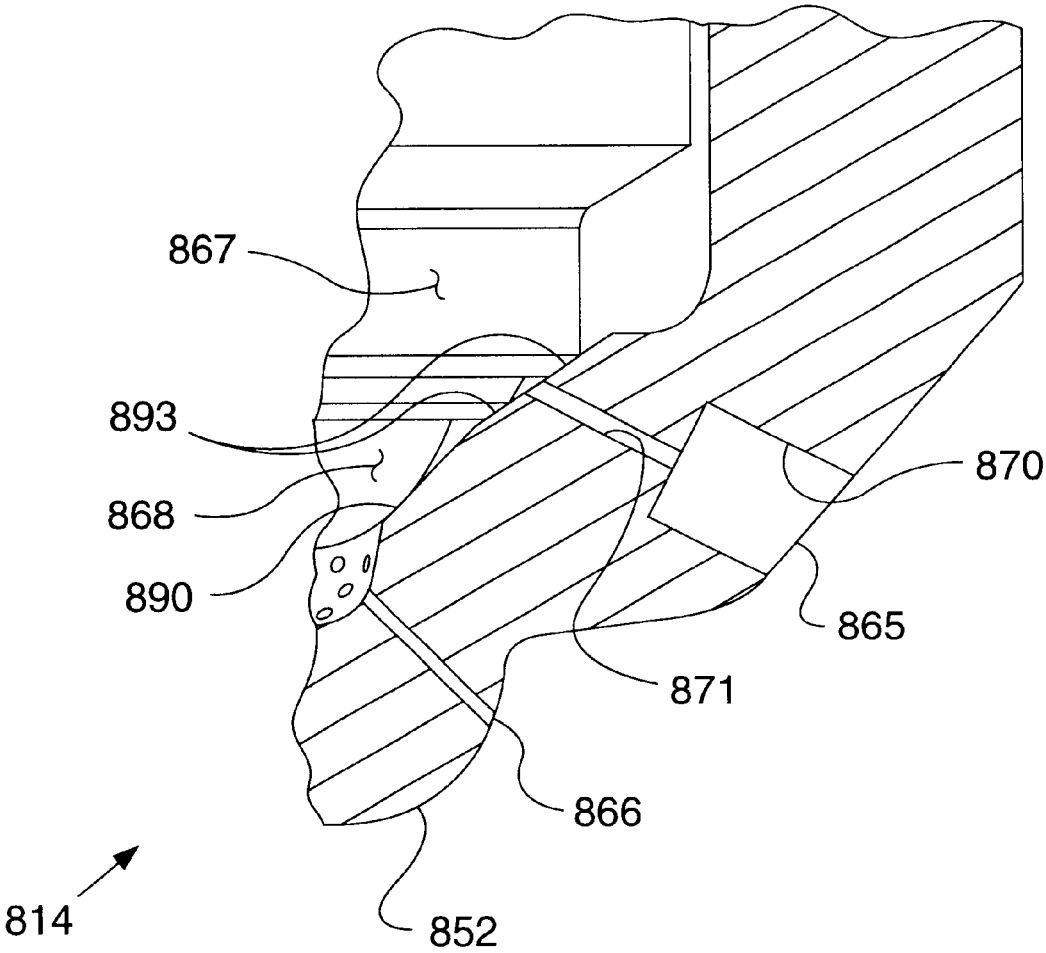
FIG. 13 is an enlarged sectioned side diagrammatic view of the tip portion of a fuel injector according to still another aspect of the present invention.

Referring now to FIG. 13, a close up sectioned view of a fuel injector 814 tip portion according to an alternative embodiment of the present invention is illustrated. This tip portion differs from the fuel injector 14 of FIGS. 2 and 3 in that the locations of the respective homogenous charge nozzle outlets and the conventional nozzle outlets have been swapped. In addition, this alternative embodiment includes two conical valve seats, rather than one conical valve seat and one flat seat as in the embodiment of FIGS. 2 and 3. Finally, the conventional nozzle outlet set 865 has fluid passages that differ from the flared passages described with regard to the previous embodiments. In particular, fuel injector 814 includes an injector body 852 that defines a homogenous charge nozzle outlet set 866 and a conventional nozzle outlet set 865. The conventional nozzle outlet set 865 each include a spray hole passageway 871 of a conventional diameter and a counter bore 870. The conventional nozzle outlet set 865 are open and closed via a conical valve seat 893 and a first or outer needle valve member 867. The seating arrangement of valve member 867 and valve seat 893 can be accomplished via a lapping process so that the valve member seats on circles located above and below the conventional nozzle outlets 865. Fuel injector 814 also includes an inner needle valve member 868 that seats on a conical valve seat 890 to open and close a homogenous charge nozzle outlet set 866. This alternative tip structure can be substituted in place of the tip structures illustrated in relation to the previous embodiments.

INDUSTRIAL APPLICABILITY

Referring now to FIGS. 1–3 and the graphs of FIGS. 10*a*–10*e*, a sample injection sequence according to the present invention will be described. Prior to the beginning of an injection sequence, first and second electrical actuators 50 and 51 are deenergized and low pressure prevails throughout fuel injector 14. In other words, pressure control valve member 55 is biased to a position that connects actuation fluid cavity 58 to low pressure drain outlet 41. In addition, plunger 61 and intensifier piston 60 are in their retracted positions and fuel pressurization chamber 63 is at low pressure as being fluidly connected past check valve 69 to low pressure fuel circulation passage 59. This also results in nozzle supply passage 64 and the various passages associated with the needle control valve to be at low pressure. In the preferred version of the present invention, the two different nozzle outlet sets are preferably configured for homogenous charge compression ignition injection and conventional fuel injection. Thus, somewhere after the engine piston 15 begins its upward compression stroke but preferably when the piston is closer to a bottom dead center position than a top dead center position, a homogenous charge injection event is desirable. In such a case, the fuel is injected early, and the fuel spray is pointed relatively downward into the engine cylinder 11 to promote the best possible mixing over the time period when the engine piston completes its compression stroke.

Figures 10A, 10B, 10C, 10D, 10E:
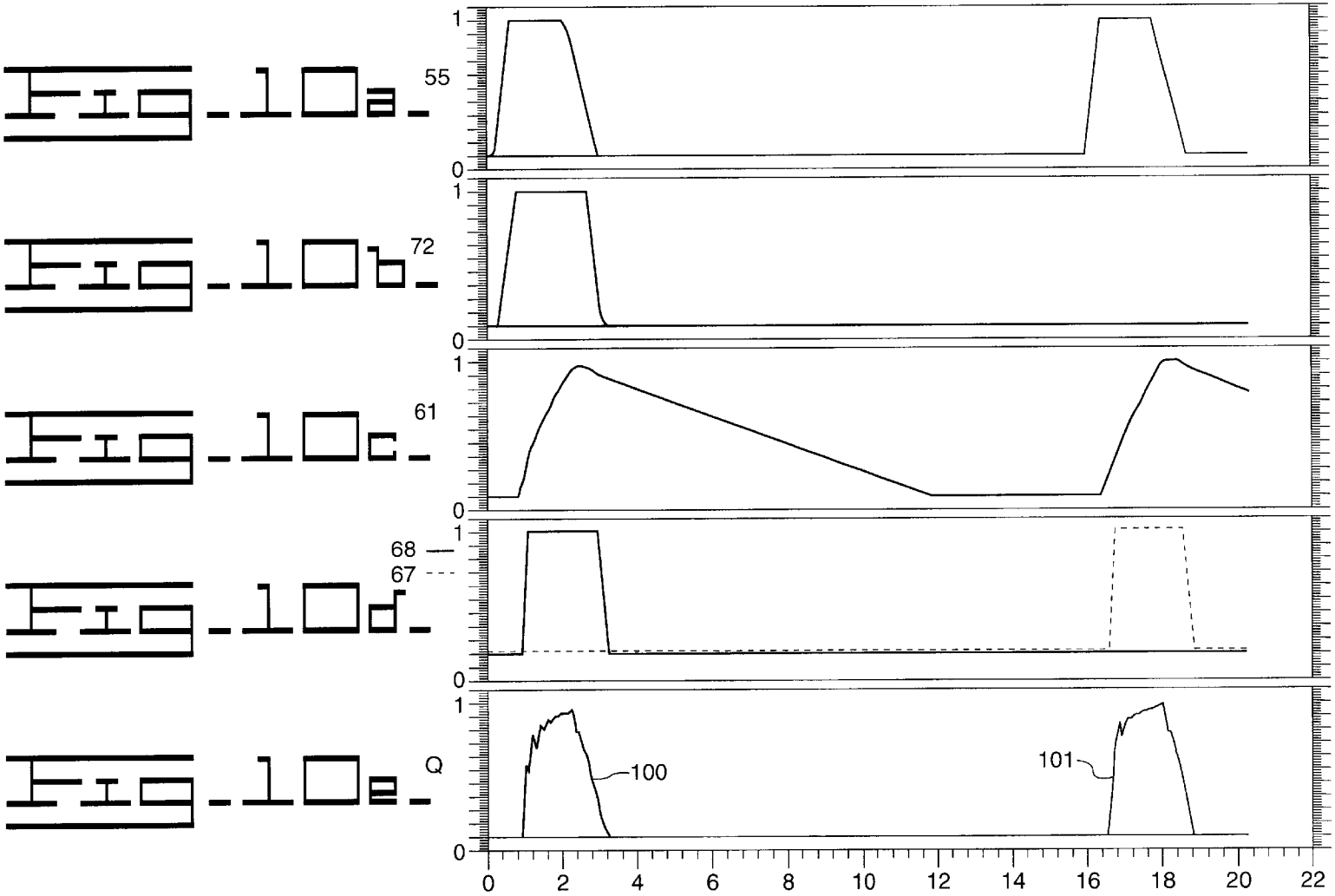
FIGS. 10*a*–10*e* are graphs of pressure control valve member position, needle control valve member position, plunger position, first and second needle valve member positions and fuel injection rate verses time for an example injection sequence according to the present invention.

Shortly before the desired timing for a homogenous charge compression injection event 100 as shown in FIG. 10*e*, current is supplied to electrical actuator 50 to move pressure control valve member 55 rightward to close low pressure drain 41 and open actuation fluid cavity 58 to high pressure actuation fluid inlet 40. When this occurs, high pressure actuation fluid flows into fuel injector 14 and acts upon intensifier piston 60 causing it and plunger 61 to move downward to pressurize fuel in fuel pressurization chamber 63. This is shown by the beginning upward slope in FIG. 10*c*, but movement of the pressure control valve member from a closed position to an open position is shown in FIG. 10*a*. Electrical actuator 51 is energized at about the same time to close seat 74 and open seat 75. Downward movement of plunger 61 quickly causes fuel pressure in fuel pressurization chamber 63 to rise to injection levels. As pressure rises in nozzle supply passage 64, high pressure is communicated to first needle control chamber 80 via connection passage 76 and pressure communication passage 78. As such, the first needle valve member 67 will remain in a downward closed position as shown by the dotted line of FIG. 10*d*. However, because second needle control chamber 84 is at low pressure due to the closure of valve seat 74, second needle valve member 68 will lift upward to open homogenous charge nozzle outlet set 66 when fuel pressure exceeds a valve opening pressure sufficient to overcome the biasing spring 85. This opening of second needle valve member 68 is shown with the solid line in FIG. 10*d*. As expected, as the outer needle valve member 68 lifts to an open position, fuel commences to spray for the homogenous charge injection event 100 shown in FIG. 10*e*. Shortly before the desired amount of fuel has been injected, the homogenous charge injection event 100 is ended by deenergizing electrical actuator 50 to relieve pressure on intensifier piston 60 by opening actuation fluid cavity 58 to low pressure drain 41. When this occurs, the downward motion of plunger 61 and intensifier piston 60 ceases and the two will begin to retract at a rate influenced by the strength of return spring 62. This retraction is shown in FIG. 10*c* by the relatively long sloped portion of the plunger's movement. When plunger 61 slows and eventually stops in its downward movement, fuel pressure in fuel pressurization chamber 63 and nozzle supple passage 64 quickly drops also. When the fuel pressure drops below a valve closing pressure, outer needle valve member 68 moves downward to close homogenous charge outlet set 66 under the action of biasing spring 85. With the seating of outer needle valve member 68 on valve seat 90, the homogenous charge injection event 100 is completed. The fuel injector then has the ability to reset itself with the retraction of plunger 61 and intensifier piston 60 as the injected fuel mixes with air in the engine cylinder during the compression stroke. If nothing further were done, the homogenous charge would autoignite in the engine cylinder 15 when the engine piston is in the region of top dead center position.

Those skilled in the art will appreciate that any number of homogenous charge compression events can be performed at desired timings. Depending upon the structure of the particular fuel injector and fuel injection system, the homogenous charge injection event can be ended in more than one way. In the first way, the first electrical actuator 50 is deenergized to reduce fuel pressure below a valve closing pressure causing the outer needle valve member 68 to move downward toward its closed position under the action of its biasing spring 85. In the event that vent passages 98 and 99 are not used, the homogenous charge injection event can also be ended by de-energizing second electrical actuator 51 to end the injection event while fuel pressure is still relatively high. In such a case, downward movement of the needle control valve member 72 will trap high pressure in second needle control chamber 80 causing first needle valve member 67 to remain in its downward closed position. However, downward movement of needle control valve member 72 will open seat 74 and connect needle control chamber 84 to the high pressure fluid in nozzle supply passage 64 causing the outer needle valve member 68 to abruptly close under the action of hydraulic pressure and its biasing spring 85. Those skilled in the art will also appreciate that various end of injection rate shaping can be performed in the event that the fuel injector has a structure shown in FIG. 2 that does not include vents 98 or 99 as shown with hidden lines in FIG. 3. In other words, timing in the deenergization of first electrical actuator 50 relative to the de-energization of the second electrical actuator 51 can be adjusted to cause the outer needle valve member 68 to move toward a closed position anywhere between maximum fuel pressure and the valve closing pressure defined by biasing spring 85. Those skilled in the art will also appreciate that some hastening of the closure of the needle valve member toward the end of an injection event can be accomplished by briefly changing the energization state of the second electrical actuator 51 after the first electrical actuator 50 has been de-energized. In particular, after the first electrical actuator 50 is de-energized, fuel pressure in the fuel injector begins to fall. However, the injection event will normally not end until that fuel pressure has fallen to a level below a valve closing pressure defined by the respective biasing spring. Depending upon which injection event is ending, the closer of that needle valve member can be hastened by briefly changing the energization state of the second electrical actuator 51. This will channel the residual high pressure in the injector to the closing hydraulic surface of the respective needle valve member to assist in hastening its closer rate to end the injection event. However, the timing of this event must be carefully determined in order to prevent a brief opening of the other nozzle outlet set that would occur by relieving pressure on its closing hydraulic surface via a change in the energization state of the second electrical actuator 51. Preferably, this aspect of the present invention is employed in such a way that the needle control valve member is normally biased to a position in which a conventional injection event will occur if the second electrical actuator 51 is not energized. However, the termination of the conventional injection event could then be hastened by briefly energizing the second electrical actuator 51 toward the injection event to channel the residual, but falling, high pressure fuel to the closing hydraulic surface of the conventional needle valve member.

In the illustrated example injection sequence of FIGS. 10*a–e*, the homogenous charge injection event 100 is followed at a later time with a conventional injection event 101. In order to produce conventional injection event 101, the second electrical actuator 51 preferably remains de-energized during the conventional injection event. Shortly before the desired beginning of the conventional injection event 101, first electrical actuator 50 is energized to connect actuation fluid cavity 58 to high pressure actuation fluid inlet 40. Like before, high pressure actuation fluid acts upon intensifier piston 60, and plunger 61 is driven downward to pressurize fuel in fuel pressurization chamber 63. As fuel pressure rises, this pressure is communicated to second needle control chamber 84 and acts upon closing hydraulic surface 86 to maintain outer needle valve member 68 in contact with valve seat 90 to close or block homogenous charge nozzle outlet set 66. However, this same rise in fuel pressure acts upon the opening hydraulic surface 91 of inner needle valve member 67 causes it to lift upward to open conventional nozzle outlet set 65 when the fuel pressure exceeds a valve opening pressure, which is related to the sizing of various hydraulic surfaces and the strength of spring 82. Shortly before the desired end of the conventional injection event, first electrical actuator 50 is deenergized to move pressure control valve member 55 back to a position that connects actuation fluid cavity 58 to low pressure actuation fluid drain 41. This results in plunger 61 and intensifier piston 60 coming to a stop and eventually beginning to retract as shown in FIG. 10*c*. By slowing and ceasing the downward movement of plunger 61, fuel pressure in fuel pressurization chamber 63 and nozzle supply passage 64 quickly drops below a valve closing pressure that causes second needle valve member to move downward to close valve seat 93 and block conventional nozzle outlet set 65. This aspect is shown in FIG. 10*d*. With the closure of seat 93, the conventional injection event 101 ends. Sharper closing of the inner needle 67 can be accomplished by supplying current to valve 51 before the conventional injection event has completed.

Those skilled in the art will appreciate that if the needle control chambers 80 and 84 are not vented as shown in shadow with vents 98 and 99 in FIG. 3, the conventional injection event can be ended in another way. In other words, the conventional injection event can be ended by energizing second electrical actuator 51 in order to apply high pressure fuel to the closing hydraulic surface 81 of second needle valve member 67. When this occurs, the trapped high pressure fuel acting on closing hydraulic surface 86 maintains outer needle valve member 68 closed, while the routing of high pressure to needle control chamber 80 causes inner needle valve member to close abruptly. Thus, this aspect of the invention can permit for some end of injection rate shaping of a type previously described so that the fuel pressure at the end of injection, when the needle valve member begins moving toward a closed position, can be chosen between maximum injection pressure and the valve closing pressure of the needle valve member. Although only a single conventional injection event was shown, those skilled in the art will appreciate that the present invention can accomplish a plurality of conventional injection events at desired timings.

The fuel injector of FIG. 4 operates in a similar manner except injection events are begun and ended by energizing or deenergizing first electrical actuator 150. In other words, regardless of whether either of the needle control chambers is vented to a low pressure area, each injection event is begun by energizing first electrical actuator 150 and ended by deenergizing the same. In the structure shown in FIG. 4, the second electrical actuator 151 acts as a switch to determine which type of injection will take place. If the second electrical actuator 151 is energized, a homogenous charge injection event will occur. If second electrical actuator 151 is de-energized before electrical actuator 150, a conventional injection event will occur. The embodiment of FIG. 4 also has the ability to end either of the injection events by changing the energization state of second electrical actuator 151 as described in relation to the un-vented version of fuel injector 14.

Referring now to FIG. 5, an injection event will be initiated when nozzle supply passage 264 is connected to a source of high pressure fuel. This high pressure fuel can come from a common rail, from underneath a cam actuated plunger, from a unit pump or from a fuel pressurization chamber of a type shown in FIG. 2. Assuming that nozzle assembly 247 is substituted in place of nozzle assembly 47 of FIG. 2, a homogenous charge injection event is initiated by energizing first electrical actuator 50 to open actuation fluid cavity 58 to high pressure actuation fluid 40. This causes piston 60 and plunger 61 to move downward to pressurize fuel in fuel pressurization chamber 63 and nozzle supply passage 264. Second electrical actuator 251 remains in an un-enerigized state such that needle control valve member 272 closes second seat 275 but opens first seat 274. When in this position, first needle control chamber 280 is fluidly connected to low pressure fuel passage 259 via pressure communication passage 278 and connection passage 276. Because the flow restriction 242 is more restrictive than the flow restriction 244, pressure in needle control chamber 280 will increase but remain low relative to the high pressure fuel in nozzle supply passage 264. This will allow first needle valve member 267 to lift upward to open homogenous charge outlet set 265 when fuel pressure exceeds a valve opening pressure. On the other hand, second needle valve member 268 will remain in the downward position blocking conventional nozzle outlet set 266 since seat 275 is closed, resulting in second needle control chamber 284 rising in pressure to high levels associated with nozzle supply passage 264. Shortly before the desired end of the homogenous charge injection event, the first electrical actuator 50 is deenergized causing fuel pressure to drop throughout the fuel injector below valve closing pressures that result in first needle valve member 267 moving downward to close homogenous charge nozzle outlet set 265 under the action of its biasing spring.

A conventional injection event is accomplished by energizing second electrical actuator 251 before fuel pressure rises substantially in nozzle assembly 247, and preferably before energizing first electrical actuator 50. When this occurs, first valve seat 274 becomes closed and second valve seat 275 is opened. When this occurs, second needle control chamber 284 is fluidly connected to low pressure fuel passage 259 via pressure communication passage 277 and connection passage 276. However, first needle control chamber 280 is only connected to nozzle supply passage 264 via passage 243. Because flow restriction 240 is preferably more restrictive than flow restriction 244, a rise in pressure in nozzle supply passage 264 will result in fuel pressure in second needle control chamber 284 remaining relatively low. As such, second needle valve member 268 will lift to its open position to open conventional nozzle outlet set 266 when fuel pressure in nozzle supply passage 264 exceeds a valve opening pressure. The conventional injection event is ended by deenergizing first electrical actuator 50 to reconnect actuation fluid cavity 58 to low pressure drain passage 41. This causes a drop in fuel pressure throughout the fuel injector causing second needle valve member 268 and first needle valve member 267 to move downward in unison to close conventional nozzle outlet set 266 to end the conventional injection event.

Referring now to the fuel injector 314 of FIG. 7, fuel injection events are accomplished in a manner as described in the previous embodiment depending upon what needle control structure and fuel pressurization strategy is employed. Depending upon these factors, a conventional injection event is accomplished by lowering pressure in needle control chamber 384 while maintaining pressure in needle control chamber 380. When this is done and fuel pressure exceeds a valve opening pressure, outer needle valve member 368 and sealing valve member 340 will move upward to its open position to open conventional nozzle outlet set 366. Because the needle valve member is 367 and 368 can move separately, the inner needle valve member 367 will remain in its downward closed position closing homogenous charge nozzle outlet set 365 during the conventional injection event. A homogenous charge injection event is accomplished by having high pressure in needle control chamber 384 while relieving pressure in second needle control chamber 380. When this occurs and fuel pressure is above a valve opening pressure, inner needle valve member 367 will lift to its upward open position to open homogenous charge nozzle outlet set 365. Because of the high pressure in needle control chamber 384, outer needle valve member 368 and auxiliary valve member 340 will remain in there downward closed positions. This prevents fuel from leaking past seat 392 to leak out of conventional nozzle outlet set 366 during a homogenous charge injection event.

Referring now to FIG. 8, a conventional injection event is initiated by moving outer needle valve member 468 to an upward open position to open conventional nozzle outlet 466 in one of the manners previously described. During the conventional injection event, the inner needle valve member 467 is maintained in its downward closed position to close homogenous charge nozzle outlet set 465. During a homogenous charge injection event, outer needle valve member 468 is maintained in its downward closed position, but inner needle valve member 467 is lifted to its upward open position to open nozzle outlet set 465. The presence of guide/seal region 463 prevents fuel leakage toward conventional nozzle outlet set 466 during a homogenous charge injection event.

Referring to FIGS. 9*a* and 9*b*, a conventional injection event configuration and homogenous charge injection event configuration are illustrated, respectively. A conventional injection event is initiated by raising fuel pressure in nozzle supply passage 564 to injection pressure levels while maintaining needle control valve member 572 in its downward position closing valve seat 575. When this occurs, high pressure fuel lifts outer needle valve member 568 to open conventional nozzle outlet set 566, but the blockage created by inner projection 581 prevents low pressure fuel from reaching homogenous charge nozzle outlet set 565. Thus, outer needle valve member 568 moves to its upward open position while inner needle valve member 567 remains stationary. In order to perform a homogenous charge injection event, needle control valve member 572 is lifted to its upward position closing seat 574 before fuel pressure in nozzle supply passage 564 reaches injection pressure levels. By doing so, high pressure fuel is channeled past needle control valve member 572 into needle control chamber 580. This high pressure fuel acts upon a closing hydraulic surface shoulder of outer needle valve member 568 maintaining it in its downward closed position in contact with valve seat 590. However, the same high pressure fuel acts upon an opening hydraulic surface of inner needle valve member 567 causing it to move downward and outward to open annulus 582 to permit high pressure fuel to spray out of homogenous charge nozzle outlet set 565. Both types of injection events are ended by lowering pressuring in nozzle supply passage 564 in any of a wide variety of manners known in the art, depending upon how the fuel is pressurized and other factors.

Referring now to FIG. 11, a conventional injection event is initiated by raising fuel pressure in nozzle supply passage 664 in any of a variety of ways to injection pressure levels. At any desired timing, needle control valve 640 is moved to a position in which pressure communication passage 677 is fluidly connected to low pressure vent 642. This allows outer needle valve member 668 to move to its upward open position to allow fuel spray out of conventional nozzle outlet set 666. The conventional injection event is ended by repositioning needle control valve 640 to a position that connects pressure communication passage 677 to high pressure branch passage 641. When this occurs, high pressure fuel in needle control chamber 684 acts on closing hydraulic surface 686 and moves outer needle valve member 668 to its downward closed position to close conventional nozzle outlet set 666. A homogenous charge injection event is accomplished in much the similar manner except by movement of needle control valve 630 to a position that connects pressure communication passage 678 to low pressure drain 632. The homogenous charge injection event is ended by reconnecting pressure communication passage 678 to high pressure branch passage 631. Those skilled in the art will appreciate that the injector of FIG. 11 can also produce spray out of both nozzle outlet sets 665 and 666 simultaneously. This can be accomplished by moving needle control valve 630 and 640 to there positions that connect pressure communication passages 678 and 677 to vent passage 632 and 642, respectively.

Referring now to FIG. 12, it operates in a similar but opposite manner to the operation described with regard to the fuel injector 14 of FIGS. 2 and 3. In particular, in the fuel injector 714 of FIG. 12, a conventional injection event requires that second electrical actuator 51 be energized, whereas a homogenous charge injection event can be accomplished purely by energizing and de-energizing the electrical actuator 50 associated with the flow control valve. If the fuel injector tip of FIG. 13 were substituted in for the tip of FIG. 12, that modified fuel injector would operate much in a similar manner described with respect to the fuel injector 14 of FIGS. 2 and 3. The reason for this is both the plumbing and the nozzle outlets would be switched if such an embodiment were operated.

The present invention finds potential application in any fuel injection system where there is a desirability to have two different spray patterns available. Preferably, these two different spray patterns correspond to a homogenous charge injection spray pattern and a conventional injection spray pattern. Nevertheless, those skilled in the art will appreciate that the two different spray patterns could merely correspond to the different sized outlets, such as for instance an application of the present invention to a dual fuel engine where pilot injections are used to ignite a gaseous fuel and air mixture, or the engine runs on conventional distillate diesel fuel alone. The present invention preferably has the ability to operate in a purely homogenous mode, a mixed homogenous and conventional mode as shown in FIGS. 10*a–e*, and a pure conventional mode. This should allow an engine equipped with a fuel injection system according to the present invention to achieve low emissions over a broad range of engine operating conditions. In addition, theses different modes can be accomplished using separately moveable valve members.

It should be understood that the above description is intended for illustrative purposes only, and is not intended to limit the scope of the present invention in any way. For instance, a nozzle outlet could be an annular clearance between a valve member and the injector body, rather than being a spray bore outlet as in the illustrated embodiments. Thus, those skilled in the art will appreciate that other aspects, objects, and advantages of the invention can be obtained from a study of the drawings, the disclosure and the appended claims.

What is claimed is:

1. A fuel injector comprising:

an injector body;

a first needle valve member at least partially positioned in said injector body;

a second needle valve member at least partially positioned in said first needle valve member;

at least one of said injector body, said first needle valve member and said second needle valve member defining a first nozzle outlet set, a second nozzle outlet set, a first needle control chamber and a second needle control chamber;

said first needle valve member having a closing hydraulic surface exposed to fluid pressure in said first needle control chamber;

said second needle valve member having a closing hydraulic surface exposed to fluid pressure in said second needle control chamber;

each of said first needle valve member and said second needle valve member being movable individually inward while an other of said first needle valve member and said second needle valve member remains stationary;

a needle control valve member moveable between a first position and a second position;

said first needle control chamber being at least one of fluidly connected to a high pressure passage and fluidly blocked from a low pressure passage while said second needle control chamber is at least one of fluidly blocked from a high pressure passage and fluidly connected to a low pressure passage when said needle control valve member is in said first position; and said second needle control chamber being at least one of fluidly connected to a high pressure passage and fluidly blocked from a low pressure passage while said first needle control chamber is at least one of fluidly blocked from a high pressure passage and fluidly connected to a low pressure passage when said needle control valve member is in said second position.

2. The fuel injector of claim 1 wherein said first nozzle outlet set defines one of a first spray pattern and a second spray pattern; and said second nozzle outlet set defines an other of said first spray pattern and said second spray pattern.

3. The fuel injector of claim 1 wherein said first nozzle outlet set includes at least one first nozzle outlet which have a first average angle with respect to a centerline;

said second nozzle outlet set includes at least one second nozzle outlet which have a second average angle with respect to said centerline; and said first average angle is less than said second average angle.

4. The fuel injector of claim 1 wherein said injector body includes a flat needle valve seat.

5. The fuel injector of claim 1 wherein said first nozzle outlet set has a greater number of nozzle outlets than said second nozzle outlet set.

6. The fuel injector of claim 1 wherein said first nozzle outlet set is separated from said second nozzle outlet set by at least two annular valve seats.

7. The fuel injector of claim 6 wherein at least one of said at least two annular valve seats is a flat valve seat.

8. The fuel injector of claim 1 wherein each nozzle outlet of said first nozzle outlet set has a smaller flow area than each nozzle outlet of said second nozzle outlet set.

9. The fuel injector of claim 1 wherein one of said first nozzle outlet set and said second nozzle outlet set is positioned between an annular valve seat and an annular guide surface.

10. The fuel injector of claim 1 including a pressure control valve attached to said injector body and being movable between a first position in which said injector body is fluidly connected to a source of high pressure fluid, and a second position in which said injector body is fluidly disconnected from said source of high pressure fluid.

11. The fuel injector of claim 10 including an intensifier piston with a top side exposed to fluid pressure from said source of high pressure fluid when said pressure control valve is in said first position; and a plunger operably coupled to move with said intensifier piston and partially defining a fuel pressurization chamber.

12. A fuel injection system comprising:

a plurality of fuel injectors according to claim 1;

each of said fuel injectors being connected to a source of high pressure actuation fluid and a source of low pressure fuel.

13. A method of injecting fuel, comprising the steps of:

injecting fuel through a first nozzle outlet set at least in part by maintaining low pressure in a first needle control chamber and increasing fuel pressure in a nozzle supply passage;

injecting fuel through a second nozzle outlet set at least in part by maintaining low pressure in a second needle control chamber and increasing fuel pressure in a nozzle supply passage;

said injecting steps are performed at least in part by moving one of a first needle valve member and a second needle valve member while an other of said first needle valve member and said second needle valve member remains stationary.

14. The method of claim 13 wherein the first injecting step is performed when an engine piston is closer to a bottom dead center position than a top dead center position; and the second injecting step is performed when an engine piston is closer to a top dead center position than a bottom dead center position.

15. The method of claim 13 including a step of blocking said second nozzle outlet set during the first injecting step; and blocking said first nozzle outlet set during the second injecting step.

16. The method of claim 15 wherein the first blocking step includes moving a needle control valve member to a first position that exposes a closing hydraulic surface of said second needle valve member to high pressure in said second needle control chamber; and the second blocking step includes moving the needle control valve member to a second position that exposes a closing hydraulic surface of said first needle valve member to high pressure in said first needle control chamber.

17. The method of claim 15 wherein said step of blocking said first nozzle outlet set includes a step of locating each nozzle outlet of said first nozzle outlet set between two annular valve seats.

18. The method of claim 15 wherein said step of blocking said first nozzle outlet set includes a step of locating each nozzle outlet of said first nozzle outlet set between an annular valve seat and an annular guide surface.

19. The method of claim 15 wherein said step of blocking said first nozzle outlet set includes a step of separating said first nozzle outlet set from said second nozzle outlet set by at least two annular valve seats.

20. The method of claim 13 including the steps of:

ending injection through the first nozzle outlet set at least in part by reducing fuel pressure in the nozzle supply passage; and ending injection through the second nozzle outlet set at least in part by reducing fuel pressure in the nozzle supply passage.

* * * * *